US006735895B2

(12) United States Patent
Wada et al.

(10) Patent No.: US 6,735,895 B2
(45) Date of Patent: May 18, 2004

(54) FIXTURE OF INDICATION TAG OR THE LIKE HAVING A MAGNETIC BODY FOR MARKER

(75) Inventors: Tetsuro Wada, 2-208, Nishitobe-cho, Nishi-ku, Yokohama-shi, Kanagawa 220-0042 (JP); Mikio Kubota, Tokyo (JP)

(73) Assignees: Toska Co., Ltd., Tokyo (JP); Tetsuro Wada, Kanagawa (JP)

( * ) Notice: Subject to any disclaimer, the term of this patent is extended or adjusted under 35 U.S.C. 154(b) by 61 days.

(21) Appl. No.: 10/089,849

(22) PCT Filed: Aug. 10, 2001

(86) PCT No.: PCT/JP01/06909

§ 371 (c)(1),
(2), (4) Date: Apr. 4, 2002

(87) PCT Pub. No.: WO02/15140

PCT Pub. Date: Feb. 21, 2002

(65) Prior Publication Data

US 2002/0152589 A1 Oct. 24, 2002

(30) Foreign Application Priority Data

Aug. 11, 2000 (JP) ..... 2000-243580

(51) Int. Cl.[7] ..... G09F 3/14
(52) U.S. Cl. ..... 40/664; 40/633
(58) Field of Search ..... 40/664, 665, 633; 24/303, 66.1, 606, 17 B, 16 PB, 30.5 P; 292/307 R–326, 307 A, 307 B, 323, 325

(56) References Cited

U.S. PATENT DOCUMENTS 3,733,657 A * 5/1973 Lankton ..... 206/343
3,931,667 A * 1/1976 Merser et al. ..... 206/346
4,240,183 A * 12/1980 Sumimoto et al. ..... 24/16 PB
5,717,382 A * 2/1998 Cooper ..... 340/572.8
5,799,375 A * 9/1998 Fukami ..... 24/16 PB
5,908,110 A * 6/1999 Hirai ..... 206/345
6,025,781 A * 2/2000 Deschenes ..... 340/572.8
6,091,333 A * 7/2000 Oshima ..... 340/572.1
6,247,591 B1 * 6/2001 Grendol ..... 206/343
6,329,917 B1 * 12/2001 Leonard ..... 340/572.8
6,352,156 B1 * 3/2002 Ueno ..... 206/338
6,371,293 B2 * 4/2002 Kubota et al. ..... 206/343
2002/0121538 A1 * 9/2002 Cooper et al. ..... 227/67

FOREIGN PATENT DOCUMENTS

JP 06-037987 5/1994
JP 10-188151 7/1998
JP WO 02/15140 2/2002

* cited by examiner

*Primary Examiner*—Lesley D. Morris
(74) *Attorney, Agent, or Firm*—Rader, Fishman & Grauer PLLC

(57) ABSTRACT

A fixture of an indication tag has a magnetic body and is used as a marker for preventing, for example, items in a store or furnishings in public facilities from being removed without permission. The fixture is formed by connecting an engagement male portion (2) to one end side of a filamentous coupling portion (4) and an engagement female portion (3) to the other end side to form a loop (R) by engaging the engagement male portion (2) and the engagement female portion (3). The filamentous coupling portion (4) is formed with a filament (40) having a soft magnetic material fiber (41) in order to obscure the location of the magnetic body for the marker preventing it from being removed.

13 Claims, 18 Drawing Sheets

FIXTURE OF INDICATION TAG OR THE LIKE HAVING A MAGNETIC BODY FOR MARKER

BACKGROUND OF THE INVENTION

1. Field of the Invention

The present invention concerns a fixture of indication tag or the like having a magnetic body for marker for preventing commodities in a store or furnishings of public facilities or others from being taken away without leave.

2. Detailed Description of the Prior Art

Conventionally, a remote sensitive antitheft system has been used for preventing commodities in a store or furnishings of public facilities or others from being taken away without leave, wherein a bar code to be attached to a commodity or the like or a tag for indicating the price/quality is provided with a magnetic body for marker such as band plate piece using the magnetic reaction characteristic of a soft magnetic body to the alternating field thereof, and a sensing gate for generating the alternating field is disposed at the exit.

In the sensing system utilizing the magnetism, a magnetic body is used for marker of soft magnetic material presenting a high magnetic permeability and, a easiness of magnetization and demagnetization, such as amorphous metallic material. There, alternating field is generated by a magnetic field impression coil on the sensing gate side, a voltage pulse is generated in a detection coil (pickup coil) on the sensing gate side by the Barkhausen effect generated when the magnetization of the magnetic body for marker entered in the alternating field is inverted, and the presence/absence of the magnetic body for marker is detected without contact and remotely by detecting the voltage pulse.

Moreover, in the sensing system, after having passed through the cash desk or other regular root in a store where the magnetic body for marker is attached, if the magnetic body for marker remains detectable, the alarm sounds when passing through a similar sensing system of another store. Therefore, in order to prevent this, a deactivation (disabling) is performed to make the magnetic body for marker undetectable by the sensing system. Moreover, for the deactivation, a semi-rigid magnetic material is accompanied in practice with the magnetic body for marker of soft magnetic material.

The semi-rigid magnetic material is a magnetic material having a coercive force not as large as the permanent magnet material, but presenting a square hysteresis loop of a convenient size. In case where the semi-rigid magnetic material is not magnetized, the magnetic body for marker of the soft magnetic material deploys the Barkhausen effect by the alternating field, and is detected by the sensing system. However, in case where the semi-rigid magnetic material is magnetized by applying a high magnetic field, the magnetic force of the semi-rigid magnetic material interferes with the alternating field of the sensing system, making the detection impossible. Using this, the magnetic body for marker can be deactivated, by magnetizing the semi-rigid magnetic material, during the passage through a cash desk or other regular route.

Besides, a certain size or length is required for the magnetic body for marker to be detected at a distance, it is shaped in various forms such as strip, wire, foil, thin film, band plate piece, or others, applied to a sheet of paper, film or the like, and used as antitheft label and so on.

Then, the antitheft label is pasted to the commodity or others, and it is surveyed if the commodity is taken away without leave, by means of a sensing gate disposed at the exit of a store or the like.

However, in case where the magnetic body for marker is arranged at the back of the bar code, tag or others, the magnetic body for marker peels off easily, and does not perform the function thereof.

In addition, as the magnetic body for marker does not have the other functions, it is difficult to conceal and, hence, can be found easily; when the magnetic body for marker is found to be attached, it is cut off or pealed off, and can not accomplish effectively its antitheft function.

Especially, in order to prevent commodities in a store from being stolen, it is important to conceal the arrangement of the presence of the magnetic body for marker; therefore, it has been desired to develop materials having a magnetic body for marker whose presence would not be recognized at a first glance.

The Inventors of the present invention have proposed a security string provided with a soft magnetic material fiber that can be used for the application and the manufacturing method thereof in Japan Patent Application No. HEI 11-195919.

On the other hand, in order to attach an indication tag for indicating the price, quality or others to clothes displayed in a store, a method wherein, using an annular coupling device provided with an engagement male portion on one end of a filamentous coupling portion formed with elongated filaments or others of synthetic resin, and with an engagement female portion at the other end, the engagement male portion is passed through an through hole of the indication tag or others and an attachment hole such as button hole formed in the stuff or the like of garments or others and, thereafter, engaged with the engagement female portion to form a loop of the filamentous coupling portion, thereby attaching the indication tag of the like to the commodity or others, has been taken.

Moreover, a method using a hanger of indication tag or the like provided respectively with an engagement male portion and an engagement female portion at both ends of a filamentous coupling portion formed with elongated filaments or others of synthetic resin has been adapted. The hanger is provided with a holding portion to hold the indication tag or the like by engaging them, and a fitting portion of safety pin, loop forming body or others that can be fitted to a commodity such as garments or others, wherein the indication tag is held by the holding portion and fitted to the garments or others by the filling portion to hang the indication tag.

The filamentous coupling portion of these fixtures of indication tag or the like is formed so that the indication tag, once attached to a commodity such as garments, does not come off easily during handling, packaging or transportation and, in addition, can not be broken simply by hand operation.

SUMMARY OF THE INVENTION

The present invention devised in order to solve problems mentioned above and has an object to provide a fixture of indication tag or the like having a magnetic body for marker that can conceal the location of the magnetic body for marker and prevent it from being removed, by arranging secretly the magnetic body for marker, in a filamentous coupling portion for coupling an engagement male portion and an engagement female portion or in a filamentous coupling portion for coupling a holding portion and a fitting portion.

The fixture of indication tag or the like having a magnetic body for marker to achieve the object is configured as follows.

A fixture of indication tag or the like is formed by connecting an engagement male portion to one end side of a filamentous coupling portion and an engagement female portion to the other end side, and forming a loop by engaging the engagement male portion and the engagement female portion, wherein the filamentous coupling portion is formed with a filament having a soft magnetic material fiber.

According to the fixture of indication tag or the like formed by connecting the engagement male portion to one end side of the filamentous coupling portion and the engagement female portion to the other end side, an indication tag or the like can be attached simply to a commodity or others by forming a loop of the filamentous coupling portion, through engagement between the engagement male portion and the engagement female portion.

Otherwise, a fixture for hanging an indication tag or the like is configured, comprising a filamentous coupling portion, a crossbar portion joined to one end side of the filamentous coupling portion crossing with the filamentous coupling portion, and a head joined to the other end side of the filamentous coupling portion and at the same time formed larger than the cross-section area of the filamentous coupling portion, and having a loosening prevention function, wherein the filamentous coupling portion is formed with filament having soft magnetic material fiber.

According to the fixture of indication tag or thelike having the crossbar poriton and the head, a substantially H shape is formed by the crossbar portion, the filamentous coupling portion and head, the intermediate filamentous coupling portion is inserted into the garments or indication tag, and a loop of filamentous coupling portion if formed with the crossbar portion and head serving as a slipping-off protector for performing the loosening prevention function, allowing to attach simply the indication tag or the like to a commodity or others.

Or, a fixture for hanging an indication tag or the like is configured, comprising a holding portion having an engagement male portion and an engagement female portion made of synthetic resin and holding an indication tag or the like by engaging the engagement male portion and the engagement female portion, a fitting portion capable of being fitted to a commodity such as garments, and a filamentous coupling portion for coupling the holding portion and the fitting portion, wherein the filamentous coupling portion is formed with a filament having a soft magnetic material fiber.

According to the fixture of indication tag or the like is configured, having respectively the holding portion on one end side of the filamentous coupling portion, and the fitting portion on the other end side, as the fixture of indication tag or the like can be held by engaging the engagement male portion and engagement female portion made of synthetic resin of the holding portion and fitted to a commodity such as garments by the fitting portion, the indication tag or the like can be attached simply to a commodity or others.

Then, in these fixtures of indication tag or the like having a magnetic body for marker, as the filament, the aforementioned filament, in short, one formed from a soft magnetic material fiber, or a soft magnetic material fiber and a core yarn, and formed by coating the core material with cover material, or one formed by coating the core material with cover material together with semi-rigid magnetic material or heat welding yarn, can be used.

According to the aforementioned composition, a soft magnetic material fiber constituting the magnetic body for marker is arranged as core material, in the filamentous coupling portion forming a loop, and the core material is coated with cover material, preventing the consumer from noticing the presence of the magnetic body for marker in the filamentous coupling portion, at a first glance, and allowing to use as an effective marker.

Besides, as magnetic body for marker being arranged in the filamentous coupling portion, it becomes easy to secure a length for generating a magnetic force necessary for sensing by the sensing system. In short, a sufficient length to be detected in the sensing gate, and a detection signal can be generated by a detection coil in the gate, through an easy magnetization in the alternating filed generated in a magnetic type antitheft gate.

In addition, the filament forming the filamentous coupling portion is identical to an ordinary filament in terms of appearance and highly concealing; therefore, a feeling of wrongness does not occur when an indication tag is attached to a commodity or others by means of a fixture of indication tag or the like having the magnetic body for marker, and the consumer or others do not notice the presence of the magnetic body for marker. Consequently, cutting off or destruction by the consumer or others disappear, allowing to fulfill the antitheft function satisfactorily.

Hence, the use of the fixture of indication tag or the like having a magnetic body for marker permits to fulfill a security function such as antitheft, in addition to applications such as normal tagging or the like.

Moreover, in the aforementioned fixture of indication tag or the like having a magnetic body for marker, the filament having the soft magnetic material fiber is formed by forming a core material thereof from a soft magnetic material fiber, or a soft magnetic material fiber and a core yarn, and coating the core material with cover material.

According to the composition, as the soft magnetic material fiber constituting the magnetic body for marker is coated with the cover material, the presence of the magnetic body for marker can be concealed and, furthermore, damage of fingers or commodities by an exposed soft magnetic material fiber.

In addition, the nature or color of the cover material can be used for identification of size, kind, material or others of a commodity to which the fixture of indication tag or the like is attached.

Otherwise, in the aforementioned fixture of indication tag or the like having a magnetic body for marker, the filament having the soft magnetic material fiber is formed by forming a core material thereof from a soft magnetic material fiber, or a soft magnetic material fiber and a core yarn, and coating the core material with cover material together with a semi-rigid magnetic material.

According to the composition, as the semi-rigid magnetic material is formed appending to the soft magnetic material fiber constituting the magnetic body for marker, the magnetic body for marker can be deactivated easily.

Or, in the aforementioned fixture of indication tag or the like having a magnetic body for marker, the filament having the soft magnetic material fiber is formed by forming core material thereof from a soft magnetic material fiber, or a soft magnetic material fiber and a core yarn, and coating the core material with cover material together with a heat welding yarn.

According to the composition, as it is formed by appending a heat welding yarn, the core material and the cover material can be integrated by adhesion of the heat welding yarn. Therefore, the soft magnetic material fiber can be prevented from slipping off, and also fingers or goods are protected from damage by avoiding the exposure of the soft magnetic material fiber.

Especially, according to the fixture of indication tag or the like having a magnetic body for marker coupling the engagement male portion and the engagement female portion by means of the filamentous coupling portion, a loop can be formed with the filamentous coupling portion by one-touch operation and the indication tag can be attached to the commodity, by inserting and pushing the engagement male portion into the engagement female portion, by inserting one end side of the filamentous coupling portion into the hole of an indication tag such as price tag and a portion inside the button hole or handle of the commodity or others.

Then, the fixture of indication tag or the like having a magnetic body for marker is formed as continuous body so as to allow to maintain the arrangement without entanglement during the usage of a gun type attachment apparatus as mentioned, for instance, in Japan Patent Application No. HEI 9-209255 and, during transportation and custody. The continuous body is the one allowing an easy loading on the attachment apparatus and moreover, a simple decomposition into pieces, and is composed as follows.

First, the engagement male portions are linked by a first linkage member through a first cutting portion where the portion is reduced and, at the same time, the engagement female portions are linked by a second linkage member through a second cutting portion where the portion is reduced, forming a flat plate lattice shape continuous body.

Second, the engagement male portions are linked each other by a first temporary linkage member formed with a filamentous small cross-section area and, at the same time, the engagement female portions are linked by a second linkage member through a second cutting portion where the portion is reduced, forming a flat plate lattice shape continuous body.

Third, the engagement male portions are linked each other by a first temporary linkage member formed with a filamentous small cross-section area and, at the same time, the engagement female portions are linked each other by a second temporary linkage member formed with a filamentous small cross-section area, forming a flat plate lattice shape continuous body.

Also, it may so composed that the engagement female portions are linked each other by a second temporary linkage member formed with a filamentous small cross-section area, and at the same time, the engagement male portions are linked by a first linkage member through a first cutting portion where the portion is reduced, forming a flat plate lattice shape continuous body.

Then, along the usage and custody method or the mechanism of the attachment apparatus, the first linkage member and the second linkage member are installed, respectively, in the elongation direction of the filamentous coupling portion, namely, in a flat plate lattice plane or, in a plane parallel with the flat plate lattice plane.

Otherwise, the first linkage member and the second linkage member are installed in a direction crossing with the elongation direction of the filamentous coupling portion, preferably in an orthogonal direction. In short, the first linkage member and the second linkage member are installed in respective planes crossing the flat plate lattice plane. The plane where the first linkage member is arranged and the plane where the second linkage member is arrange may be parallel or not, but it is preferably to cross the flat plate lattice plane at right angles because the composition can be simplified.

There, entanglement of engagement male portion each other or engagement female portion each other, or dislocation of the arrangement of fixture of indication tag or the like can be prevented by affording a convenient rigidity to the linkage member.

According to the composition mentioned above, the arrangement can be maintained without entanglement during the usage of a gun type attachment apparatus or, during transportation or custody, by forming the fixture of indication tag or the like having a magnetic body for marker wherein the engagement male portion and the engagement female portion are coupled by the filamentous coupling portion as a continuous body by linking with the first linkage member and the second linkage member. Also, the formation into the continuous body assures an easy loading on the attachment apparatus and moreover, a simple decomposition into pieces.

Especially, in case of loading on a gun type attachment apparatus or others, a number of fixtures of indication tag or the like can be loaded simply leaving them in aligned state, by using the rigidity of the linkage member of both ends or one side thereof.

It should be appreciated that in case of individualizing fixtures of indication tag or the like inside a gun type attachment apparatus, one piece can be cut off simply, by cutting the portion of cutting portion where the portion is reduced by a knife provided on the attachment apparatus side.

Moreover, the axial line in the engagement direction of the engagement male portion and the axial line in the engagement direction of the engagement female portion are formed respectively to cross the flat plate lattice plane, preferably at right angles.

If the composition is adopted, the loading on a gun type attachment apparatus does not provoke entanglement, because the engagement male portion and the engagement female portion can be loaded leaving the filamentous coupling portion of the fixture of indication tag or the like having a magnetic body for marker arranged in a sheet form continuous body disposed outside the attachment apparatus in U-shape, and, the filamentous coupling portion can be forwarded leaving in the U-shape, when it is advanced toward the tip side.

Besides, in the composition, as the first cutting portion or the first temporary linkage portion can be not disposed at the rear end of the engagement male portion, a mechanism for forwarding from a hollow needle by pressing the rear end by means of an ejection rod, as mechanism for forwarding engagement male portion in the attachment apparatus.

It should be appreciated that, in case of attaching an indication tag or the like by forming a loop manually, it can be taken apart simply into pieces, by cutting the portion of first and second cutting portion and first and second temporary linkage portions by scissors, cutter, nail or others.

Then, in the fixture of indication tag or the like having a magnetic body for marker coupling the engagement male portion and the engagement female portion by means of the filamentous coupling portion, a breaking portion formed weaker than the engagement strength between the engagement male portion and the engagement female portion is installed at the joint portion between the engagement male portion and the filamentous coupling portion, or the joint portion between the engagement female portion and the filamentous coupling portion.

The indication tag attached to a commodity by forming a loop made of the filamentous coupling portion by engaging the engagement male portion with the engagement female portion can be removed simply by installing the breaking portion with a reduced portion or forming a notch or hole. In other words, the breaking portion can be cut off only by pinching both side portions of the breaking portion with fingertips and bending or twisting, without using scissors, cutter or the like.

Hence, the engagement male portion or the engagement female portion can be separated from the filamentous coupling portion extremely simply, and a commodity tag or the fixture of indication tag or the like having a magnetic body for marker can be removed from the commodity.

DETAILED DESCRIPTION OF THE PREFERRED EMBODIMENTS

Now, embodiments of the fixture of indication tag or the like having a magnetic body for marker according to the present invention shall be described based on the drawings.

First, a fixture of indication tag or the like having a magnetic body for marker which is the first embodiment of the present invention shall be described.

Figure 1A:
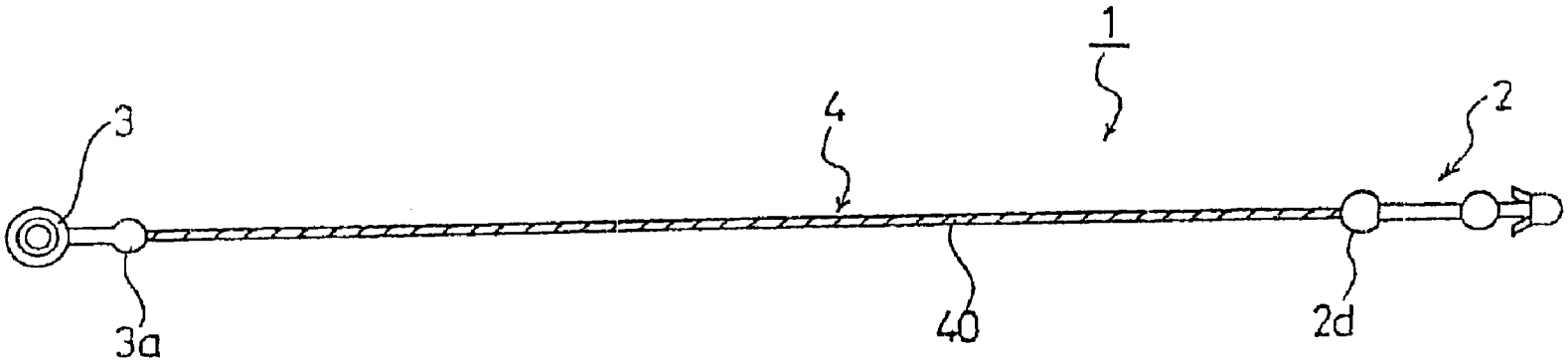
FIG. 1 shows a first example of the fixture of indication tag or the like having a magnetic body for marker of a first embodiment of the present invention, (a) is a plane view and (b) a front view.
Figure 1B:
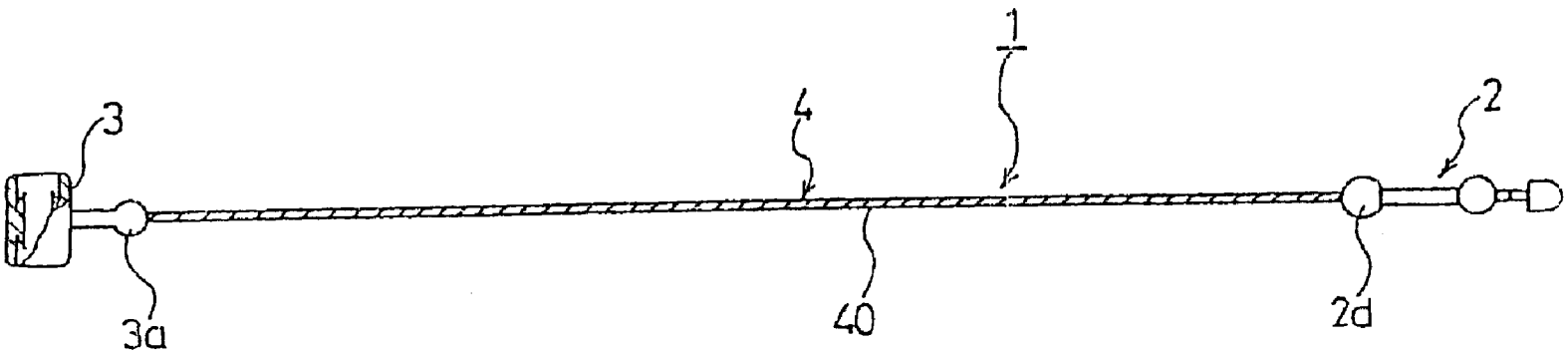
Figure 2A:
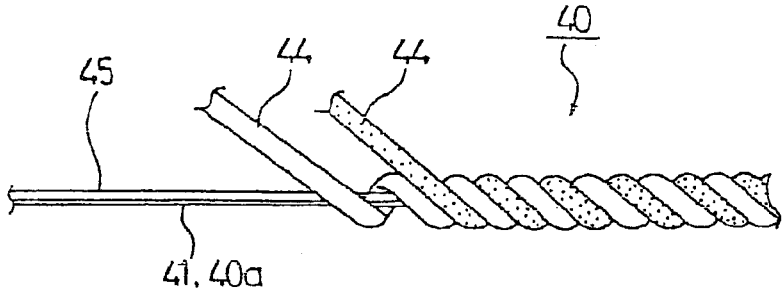
FIG. 2 shows the filament, (a) a filament where the core material is formed of a soft magnetic material fiber, (b) a filament where the core material is formed of a soft magnetic material fiber and a core yarn, and (c) a filament formed by appending a semi-rigid magnetic material to the core material, respectively.
Figure 2B:
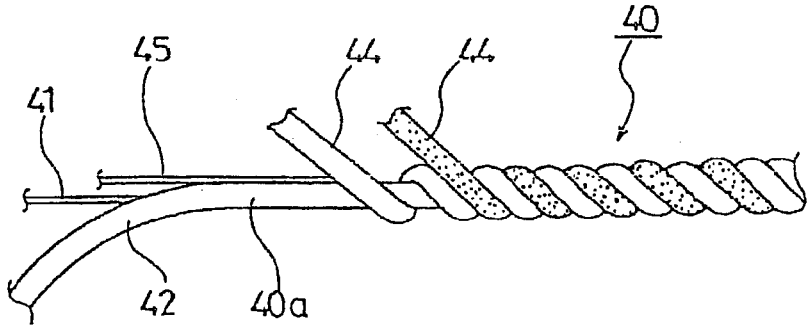
Figure 2C:
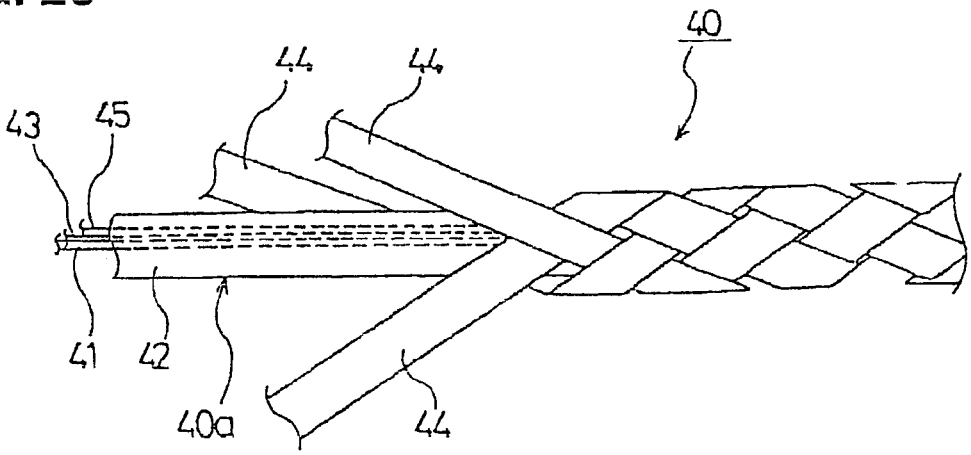

The fixture 1 is configured by installing an engagement male portion 2 on one end side of a filamentous coupling portion 4 and an engagement female portion 3 engaging with the engagement male portion 2 on the other end side as shown in FIG. 1 and, at the same time, forming the filamentous coupling portion 4 with a filament 40 having a soft magnetic material fiber 41 as shown in FIG. 2.

Figure 3A:
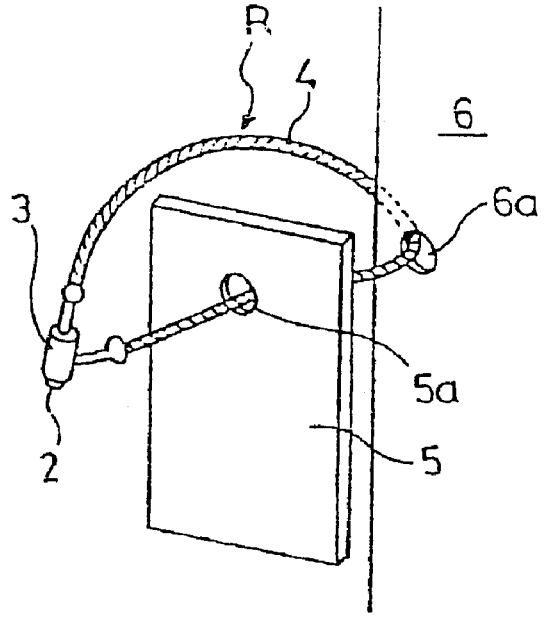
FIG. 3 shows a state where a loop is formed by the fixture of indication tag or the like having a magnetic body for marker of FIG. 1, (a) the attachment sate of the indication tag, and (b) the engagement state between engagement male portion and engagement female portion.
Figure 3B:
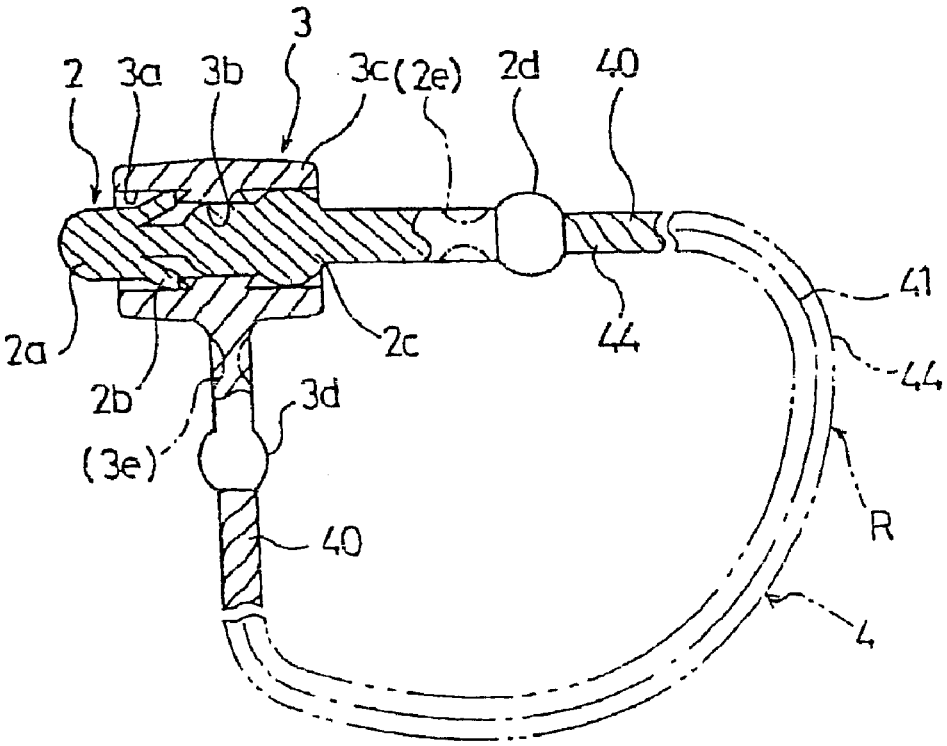
Figure 4A:
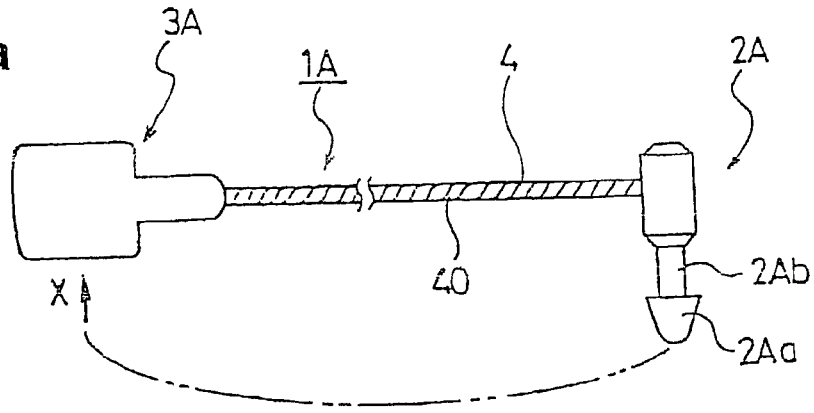
FIG. 4 shows a second example of the fixture of indication tag or the like having a magnetic body for marker of the first embodiment of the present invention, (a) is a plane view, (b) a front view, (c) a bottom view, and (d) a section view of the engagement female portion.
Figure 4B:
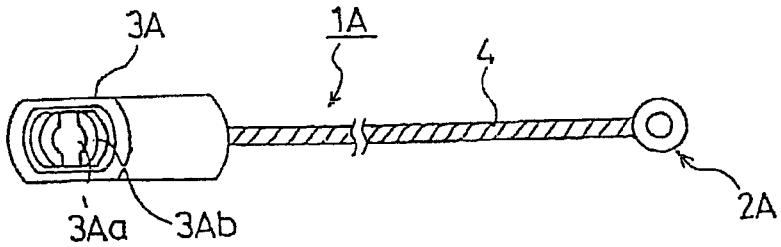
Figure 4C:
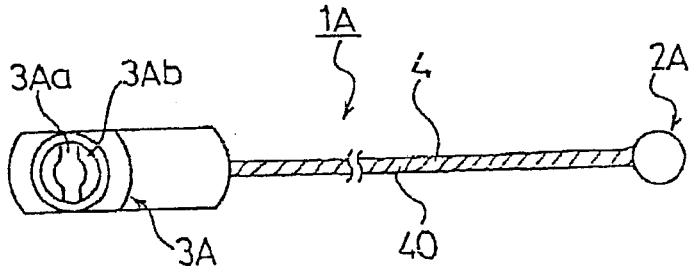
Figure 4D:
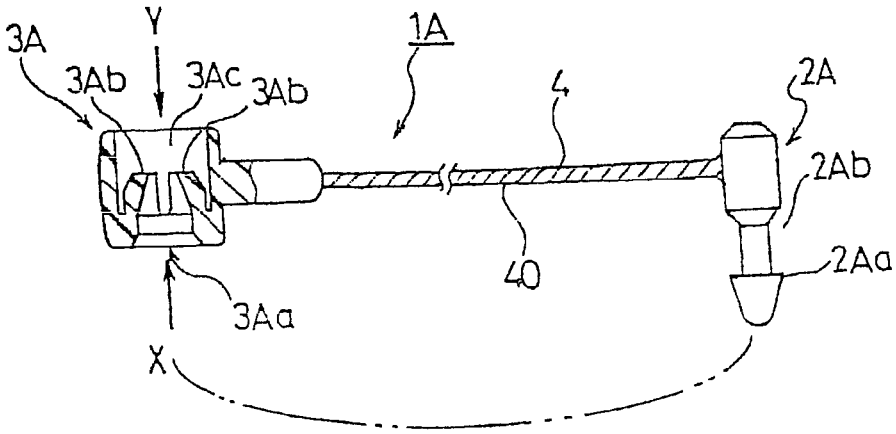

These engagement male portion 2 and engagement female portion 3 are made of synthetic resin or the like, engaged as shown in FIG. 3, formed into a loop R, and configured to allow attaching an indication tag 5 to a commodity 6 such as garments or others.

These engagement male portion 2 and engagement female portion 3 are formed so that the indication tag, once attached to a commodity such as garments, does not come off easily during handling, packaging or transportation and, in addition, provided with a such tensile strength that can not be broken simply by hand operation and, moreover, formed so that the trace of breaking or destruction remains in case of breaking or destruction thereof.

Next, a filament 40 forming filamentous coupling portion 4, shall be described.

The filament 40 is, as shown in FIG. 2, formed by coating a core material 40*a* made of a soft magnetic material fiber 41 or a core yarn 42 with cover material 44, and the cover material 44 conceals the presence of the soft magnetic material fiber 41 constituting the magnetic body for marker, and moreover, damage of fingers or commodities by an exposed the soft magnetic material fiber 41 can be prevented.

In addition, a semi-rigid magnetic material 43 is coated with cover material 44 together with the core material 40*a* as shown in FIG. 2(*c*) so that the aforementioned fixture 1 can be deactivated. According to the configuration, it becomes possible to make the sensing by the sensing system impossible, through deactivation of the soft magnetic material fiber 41, by magnetizing the semi-rigid magnetic material 43 by passing through a magnetic field of a permanent magnet or others, during the passage through a regular root such as a cash desk or others.

Moreover, the soft magnetic material fiber 41 can be prevented from slipping down and exposition by interposing a heat welding yarn 45 and integrated the core material 40*a* and the cover material 44 through fusion of the heat welding yarn 45, after coating treatment with the cover material 44 and dry heat treatment.

The soft magnetic material fiber 41 is not specially limited in terms of crystalline structure such as crystalline/amorphous or other, or alloy composition, and formed of a magnetic material showing a soft magnetic property of facilitating magnetization and demagnetization.

However, those having a high magnetic permeability of 1,000 or more in an excited filed where the field intensity is 0.4 A/m (5 mOe: millioersted) and the frequency of alternating field is 1 kHz are preferable, and the material showing the high magnetic permeability includes permalloy, Fe—Si base alloys, amorphous metals, or others.

Especially, an amorphous metallic fiber mainly composed of Co—Fe—Si—B shows a high magnetic permeability of 10,000 or more in an excited filed where the field intensity is 0.4 A/m (5 mOe) and the frequency of alternating field is 1 kHz, and, an amorphous metallic fiber mainly composed of Fe—Co—Si—B has a large Barkhausen effect; therefore, it is preferable to use these amorphous metallic fibers.

The semi-rigid magnetic material 43 needs a retention equal or superior to about 800 A/m (10 Oe (oersted)) and equal or inferior to about 40,000 A/m (500 Oe) and various Fe alloys and Co alloys can be used and, among them, Fe—Co—V base alloys and Fe—Co—Cr base alloys are preferable, because they present an excellent semi-rigid magnetic material property of equal or superior to about 2,400 A/m (30 Oe (oersted)) and equal or inferior to about 12,000 A/m (150 Oe).

Besides, concerning the configuration of the semi-rigid magnetic material 43, wires having circular portion, elliptic portion or polygonal portion, and sheets or thin bands of a narrow width rectangular portion can be used, and a length equal or superior to 3 mm can afford a sufficient deactivation performance.

The core yarn 42 is preferably thicker than the soft magnetic material fiber 41, and bundled filaments made of various synthetic fiber and natural fiber, stranded filaments, heat welding yarn, staple fiber or other rayon fiber of low modulus of elasticity (Polynosic, commodity name of American Enka, Inc.) or others may be used.

For heat welding yarn 45, those having a thickness of the order of 100 to 200 d (denier) and a welding temperature of the order of 100° C.

The cover material 44 is designed for covering the soft magnetic material fiber 41, the core yarn 42, the semi-rigid magnetic material 43, the heat welding yarn 45 or others, has a function to protect them mechanically and visually, and strings or bands (tape form) molded with synthetic fibers such as nylon, polyester or the like or natural fibers can be used.

Also, as the cover material 44, golden thread or silver thread composed of various material can be used, and in case of taking the golden thread or silver thread as example, especially those where aluminum is vacuum deposited on one face of a molecular film of polyester or the like, and moreover, those colored in blue, red, green or in an arbitrary color for metallic finish may be used. These colors or others can be used not only for decorative effect, but also for identification of commodity size, kind, material or others.

Then, around the core material 40*a* of soft magnetic material fiber 41 or others or core yarns or others disposed around the soft magnetic material fiber 41 as core, a single kind of cover material 44 is wound in single spiral shape, two kinds of the cover material 44, 44 are wound in double spiral shape alternately without gap as shown in FIG. 2(*a*), FIG. 2(*b*), or using three or more golden threads, silver threads or others, these several golden threads or others are crossed slantwise, before and behind, up and down according to a certain method, tighten by driving or made into braid structure, as shown in FIG. 2(*c*), to cover with the cover material 44.

As an example of embodiment of the aforementioned filament 40, the soft magnetic material fiber 41 is formed with Co—Fe—Si—B base amorphous metal fiber of 100 $\mu m\phi$ presenting a high magnetic permeability equal or superior to 5,000, coated in spiral with the cover material 44 of two polyethylene terephthalate threads of 1,000 d, together with the core yarn 42 made of bundled filaments of heat welding yarn 45 of 200*d* and nylon of 200*d*, and Fe—Co—V base semi-rigid magnetic material 43 of 80 $\mu m\phi$ in demagnetized state, presenting a retention power of about 9,550 A/m (120 Oe), and dry heat treated for 30 min under 120° C. after coating, forming the filament 40.

Then, as the results of experiment of sensing performance or deactivation function of the filament 40, satisfactory performances for practice have been obtained.

Next, engagement male portion 2 and engagement female portion 3 shall be described.

The engagement male portion 2 and engagement female portion 3 shown in FIG. 3 are formed to comprise a head 2*a* capable of passing through an annular projection portion 3*b* in a through hole 3*a* of the engagement female portion 3, an elastically expandable engagement blade 2*b* disposed behind the head 2*a*, and a stopper portion 2*c* disposed behind the engagement blade 2*b* and enlarged by the annular projection portion 3*b*.

In the engagement male portion 2, there is a connection member between the head 2*a* and the stopper portion 2*c*, and, the stopper portion 2*c* is connected to a coupling portion 2*d* by means of the connection member. The coupling portion 2*d* is designed for joining the filament 40 and the engagement male portion 2, and the end portion of the filament 40 is enveloped in the coupling portion 2*d*.

Besides, the engagement female portion 3 is, as shown in FIG. 3, made of a frame body 3*c* having a through hole 3*a*, and an annular projection portion 3*b* provided in the through hole 3*a*, and formed by connection to the filament 40 by means of the coupling portion 3*d*.

The engagement strength between these engagement male portion 2 and engagement female portion 3 is configured to prohibit the reengagement when they are once engaged and then disengage by forced traction, through destruction of the engagement male portion 2 or engagement female portion 3, in order to prevent an indication tag 5 or the like from being taken off simply and replaced.

It should be appreciated that, as shown by the alternate long and short dash line in FIG. 3(*b*), a breaking portion 2*e* or a breaking portion 3*e* formed to be weaker than the engagement strength between the engagement male portion 2 and engagement female portion 3 by reducing the cross-section area may be provided on the connection member between the engagement male portion 2 and the filamentous coupling portion 4, or the connection member between the engagement female portion 3 and the filamentous coupling portion 4. According to the configuration, the indication tag 5 or the like can be removed from a commodity 6, by simply cutting off the engagement male portion 2 or the engagement female portion 3, through bending or twisting of the breaking portion 2*e*, 3*e*. It should be appreciated that either one breaking portion 2*e*, 3*e* is enough.

Figure 5A:
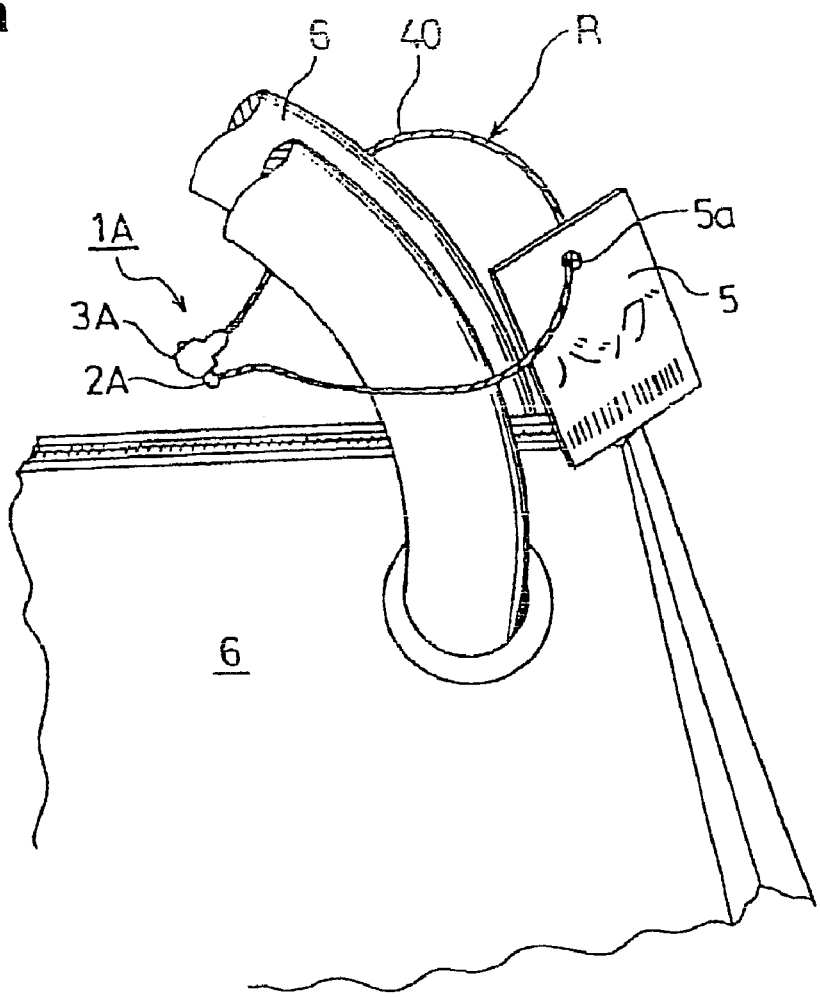
FIG. 5 shows a state where a loop is formed by the fixture of indication tag or the like having a magnetic body for marker 6*f* FIG. 4, (a) the attachment sate of the indication tag, and (b) the engagement state between engagement male portion and engagement female portion.
Figure 5B:
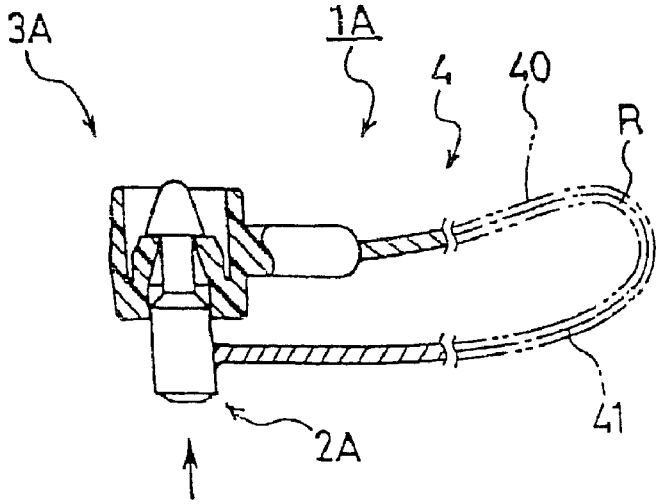

Other examples of the engagement male portion 2 and engagement female portion 3 to be coupled with the filamentous coupling portion 4 are shown in FIG. 4 to FIG. 5.

In a fixture of indication tag or the like having a magnetic body for marker 1A shown in FIG. 4, an engagement male portion 2A is formed comprising a head 2Aa and a neck portion 2Ab, while an engagement female portion 3A is formed comprising an engagement piece 3Ab and a head reception portion 3Ac, in a through hole 3Aa, and engaged as shown in FIG. 5, to form a loop R.

Figure 6A:
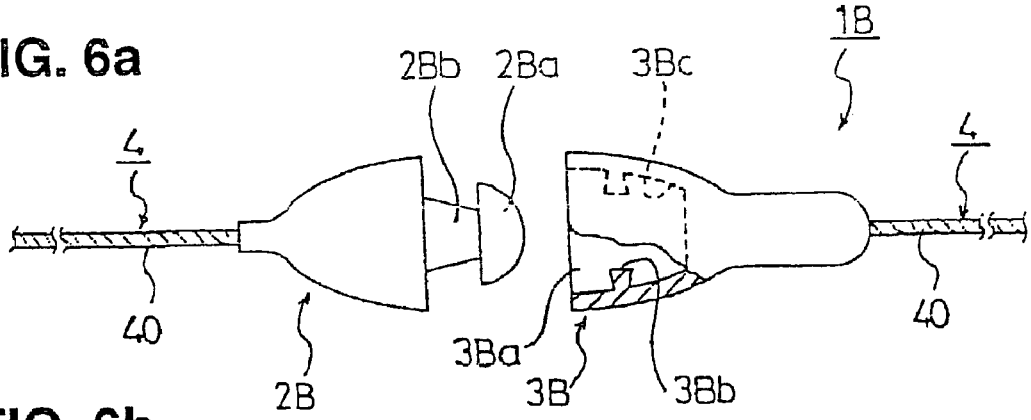
FIG. 6 shows a third example of the engagement male portion and the engagement female portion, (a) is a plane view and (b) a front view.
Figure 6B:
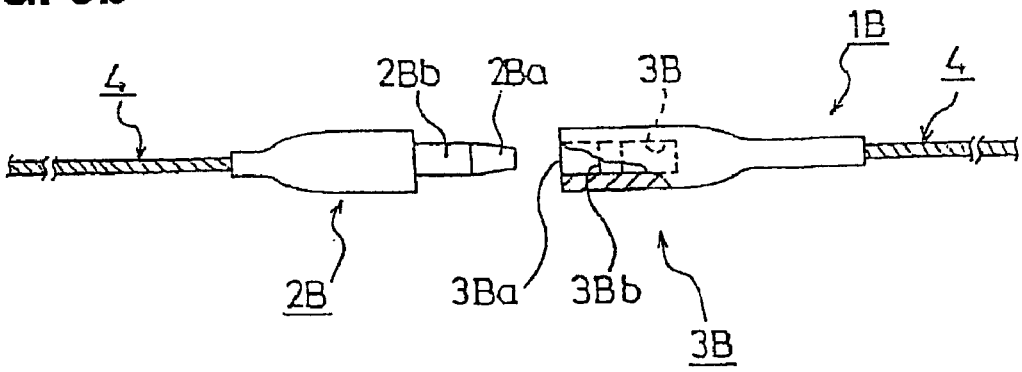

An engagement male portion 2B shown in FIG. 6 is formed flat comprising a head 2Ba and a neck portion 2Bb, while an engagement female portion 3B is formed comprising an engagement piece 3Bb and a head reception portion 3Bc, in a through hole 3Ba.

Figure 7A:
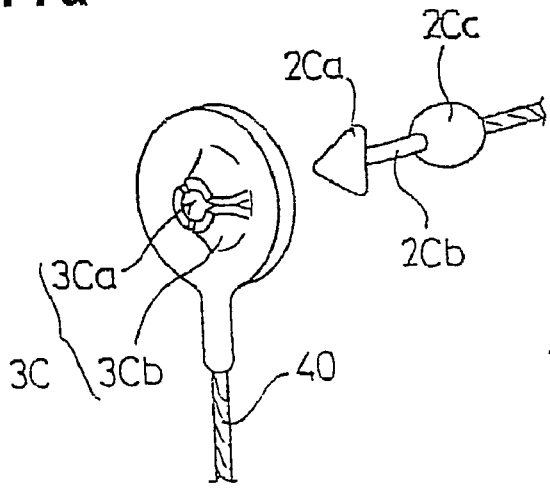
FIG. 7 shows a fourth example of the engagement male portion and the engagement female portion, (a) is a perspective view and (b) a section view showing the engagement state between engagement male portion and engagement female portion.
Figure 7B:
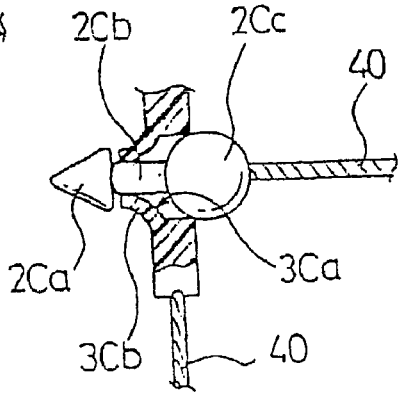
Figure 8A:
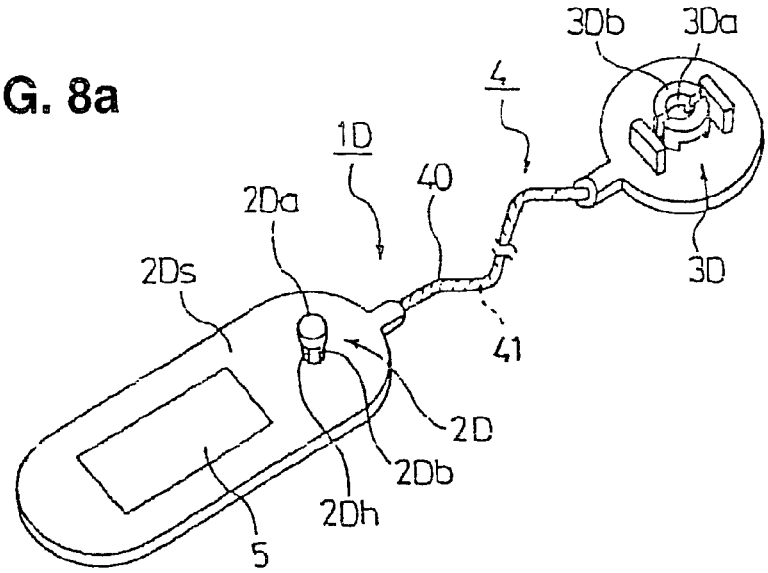
FIG. 8 shows a fifth example of button type engagement male portion and engagement female portion, (a) is a perspective view, (b) a plane view, (c) a section view of the engagement male portion and the engagement female portion, and (d) a section view showing the engagement state.
Figure 8B:
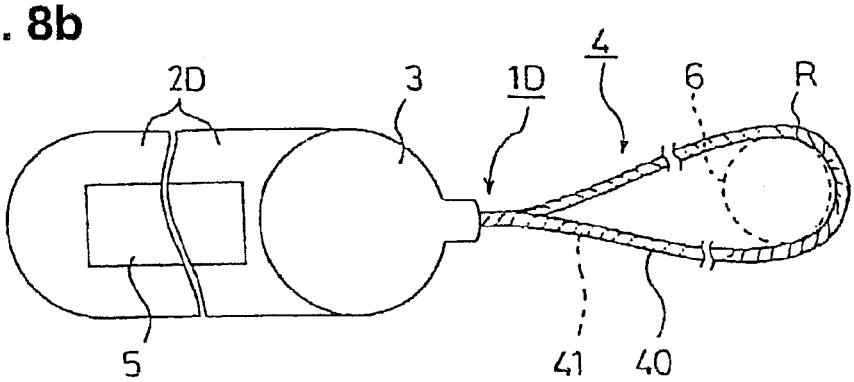
Figure 8C:
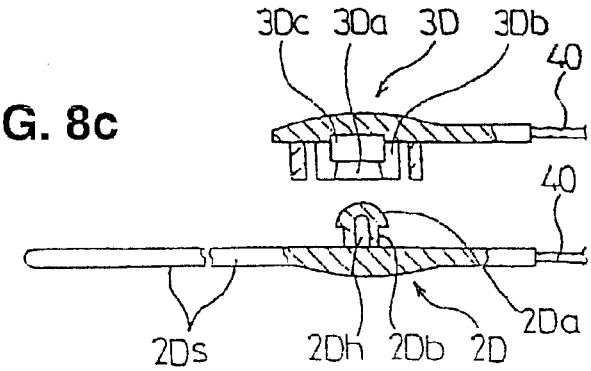
Figure 8D:
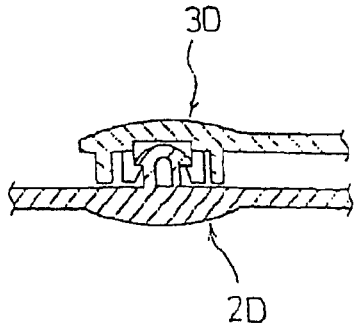

An engagement male portion 2C shown in FIG. 7 is formed comprising a head 2Ca, a neck portion 2Cb and a stopper portion 2Cc, while an engagement female portion 3C is formed comprising a through hole 3Ca and an engagement piece 3Cb formed therearound.

Moreover, in FIG. 8, a fixture of indication tag or the like having a magnetic body for marker 1D having a button type engagement male portion 2D and engagement female portion 3D is shown. The engagement male portion 2D comprises a head 2Da and a neck portion 2Db, the head is formed reducible, by a hollow portion 2Dh disposed in the neck portion 2Db, while the engagement female portion 3D is formed of a paired engagement pieces 3Db, an insertion hole 3Da to be formed between these engagement pieces 3Db, and a head reception portion 3Dc formed by a notch hole at the lower part of the engagement pieces 3Da.

Then, these engagement male portion 2D and engagement female portion 3D engage as shown in FIG. 8(*d*) and form a loop R as shown in FIG. 8(*b*).

Besides, in the fixture 1D, a indication portion 2Ds is arranged in the engagement male portion 2D, and it is configured to permit to fill the indication portion 2Ds with indication data, or paste a tag.

It should be appreciated that various cases as shown in FIG. 1 to FIG. 8 can be conceived for the positional relation of the engagement male portion 2, 2A, . . . or the engagement female portion 3, 3A, . . . in respect to the filament 40, in short, for the engagement direction, and decided conveniently for respective application. In addition, it is not limited to those shown in FIG. 1 to FIG. 8.

Also, concerning the dimensions, they are different according to the object indication tag or the object of seal, and its size can be conceived variously, making the limitation unnecessary; however, for instance, as a representative example, the fixture 1 of FIG. 1 is 100 to 250 mm in total length, the head 2*a* of the engagement male portion is 1.8 mmϕ, the filamentous coupling portion 4 is 0.4 to 1.0 mmϕ, the through hole 3*a* of the engagement female portion 3 is 2.5 mmϕ, and the through hole 3*a* is 5.0 mm long.

Next, the use method of the aforementioned fixture 1 shall be described.

It should be appreciated that, in the following description, the same component, for instance, the reference number of the engagement male portion is 2, 2A to 2D, shall be represented by 2. In short, it shall be represented omitting alphabetic letters.

The engagement male portion 2 of the fixture 1 is passed through a through hole of an indication tag 5 or the like for indicating price, quality or others and an attachment hole such as button hole or the like formed on a commodity 6 such as garments and, thereafter, is engaged with an engagement female portion 3.

The engagement allows to form a loop R for passing through the through hole of the indication tag 5 or the like and the attachment hole of the commodity 6, and the loop R allows to attach the indication tag 5 to the commodity 6, and an magnetic body for marker 41 itself to the commodity.

Then, in case where a consumer by these commodities 6, the semi-rigid magnetic material 43 is magnetized by passing through a regular route such as a cash desk or others, the soft magnetic material fiber 41 constituting the magnetic body for marker is deactivated, before delivering to the consumer. Thereby, the deactivated soft magnetic material fiber 41 can pass as it is, because it becomes insensible by the sensing gate.

On the other hand, in case of not passing through the cash desk or others, in short, in a state where the semi-rigid magnetic material 43 is not magnetized, and the soft magnetic material fiber 41 constituting the magnetic body for marker is not deactivated, as the presence thereof can by sensed by the sensing gate, the presence of a commodity not having passed through a regular route can be detected, and the theft can be prevented.

Next, a case where a fixture 1 which is the aforementioned first embodiment is formed as continuous body by coupling by means of a first linkage member 14 or a second linkage member 15 or the like shall be described taking a fixture of indication tag or the like having a magnetic body for marker 1A shown in FIG. 4 as example.

Figure 9A:
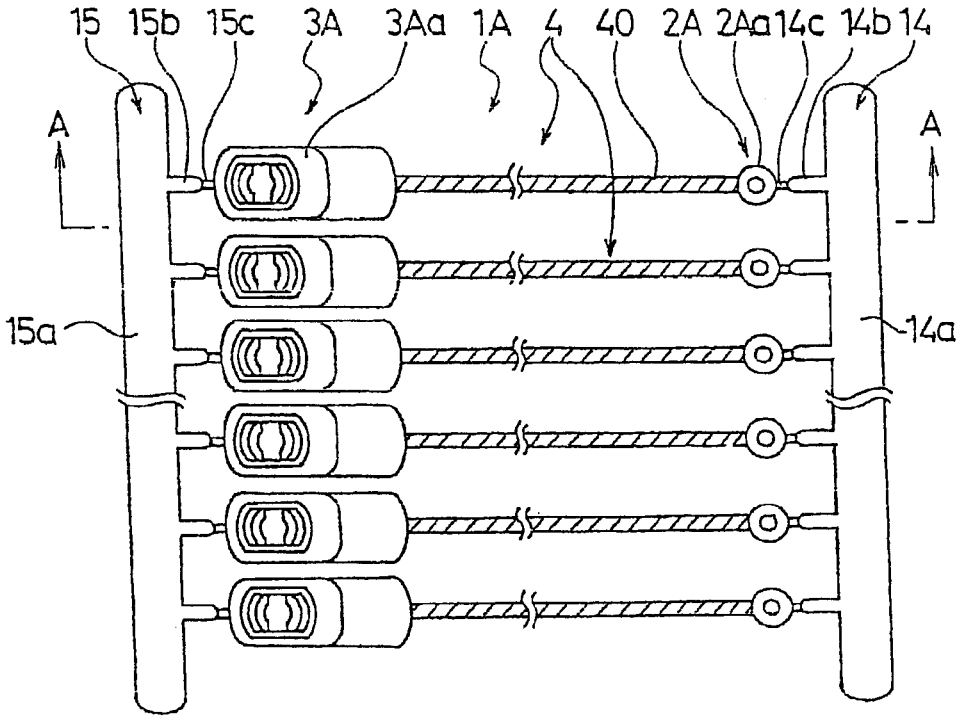
FIG. 9 shows a fixture of indication tag or the like having a magnetic body for marker formed as continuous body coupled by a first linkage member and a second coupling portion, (a) is a plane view, and (b) is a section view along A—A.
Figure 9B:
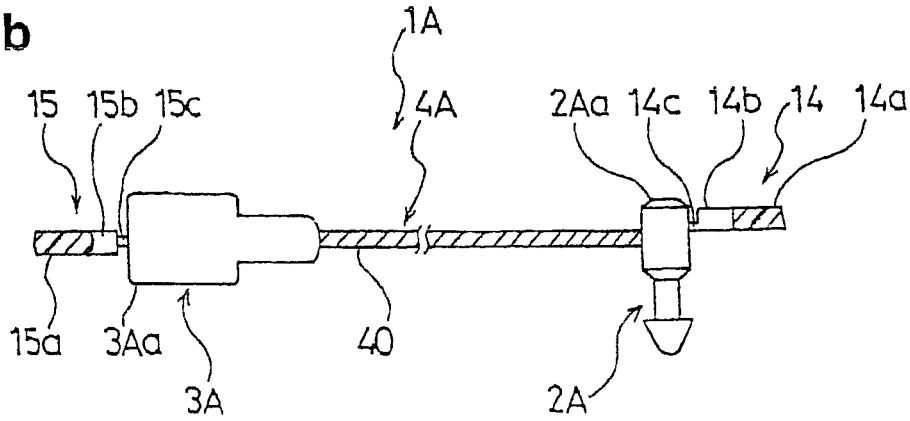

First, in a first continuous body shown in FIG. 9, the first linkage member 14 comprises a first linkage bar 14*a* having a relatively large portion and a relatively strong rigidity, a first projection portion 14*b* projecting in comb-shape from the first linkage member 14, and a first cutting portion 14*c* extending from the first projection portion 14*b*, coupling with a base portion 2Aa of the engagement male portion 2A, and, having a reduced cross-section area for facilitating the cutting.

Also, the second linkage member 15 comprises, similarly, a second linkage bar 15*a* having a relatively large portion and a relatively strong rigidity, a second projection portion 15*b* projecting in comb-shape from the second linkage member 15, and a second cutting portion 15*c* extending from the second projection portion 15*b*, coupling with a base portion 3Aa of the engagement female portion 3A, and, having a reduced portion for facilitating the cutting.

In short, the fixture 1A, in its aligned arrangement state, affixes and supports the engagement male portion 2A and engagement female portion 3A at both ends thereof, by means of the first linkage member 14 and the second linkage member 15 having a relatively strong rigidity, respectively through the first cutting portion 14*c* and the second cutting portion 15*c* easy to cut off.

Figure 10A:
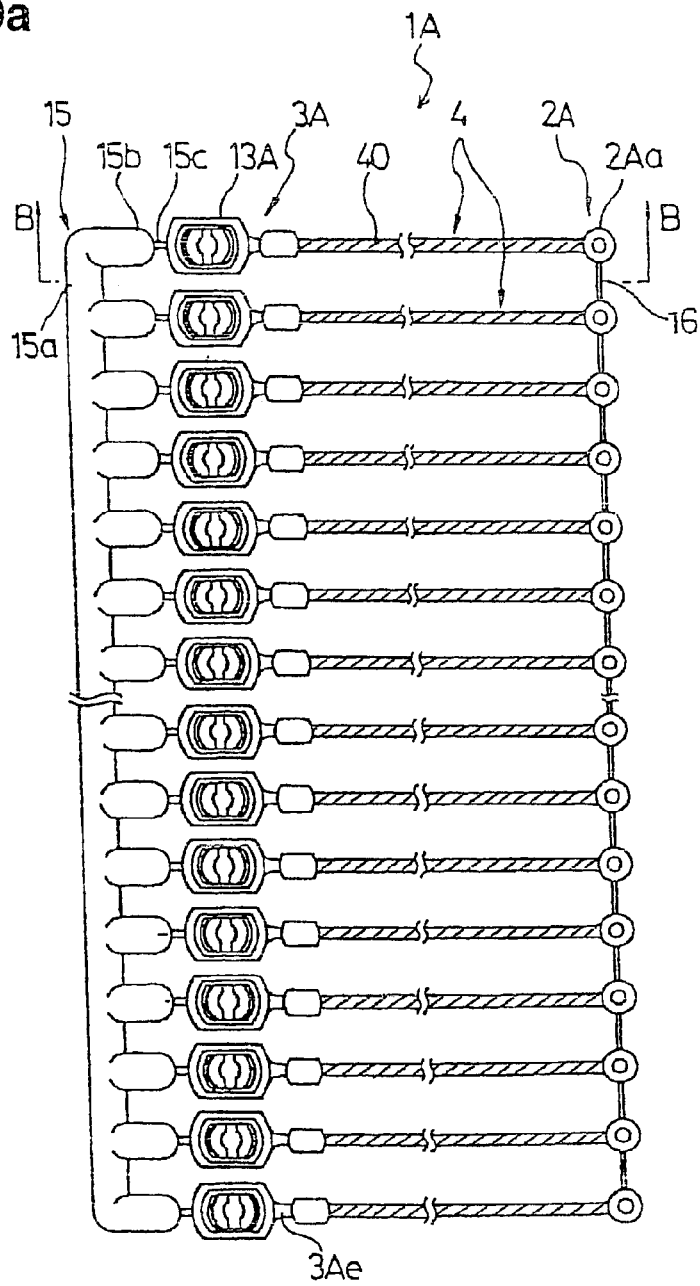
FIG. 10 shows a fixture of indication tag or the like having a magnetic body for marker formed as continuous body coupled by a first temporary linkage member and a second linkage member, (a) is a plane view, and (b) is a section view along B—B.
Figure 10B:
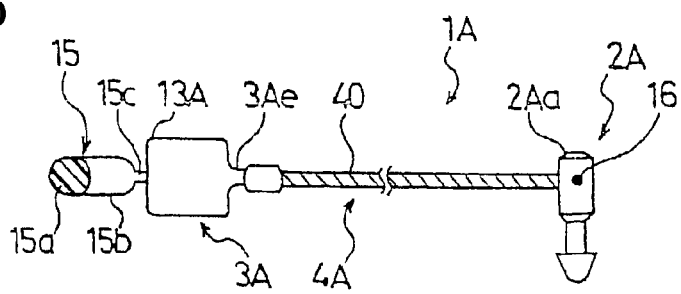

Moreover, in a second continuous body shown in FIG. 10, in the aligned arrangement state of a number of fixtures 1A of indication tag or the like having a magnetic body for marker, base portions 2Aa of the engagement male portion 2A are linked each other by means of a thin filamentous first temporary linkage portion 16 formed in a small cross-section area, and base portions 3Aa of the engagement female portion 3A are linked by a second temporary linkage member 17 having a second cutting portion 15*c*.

Figure 11A:
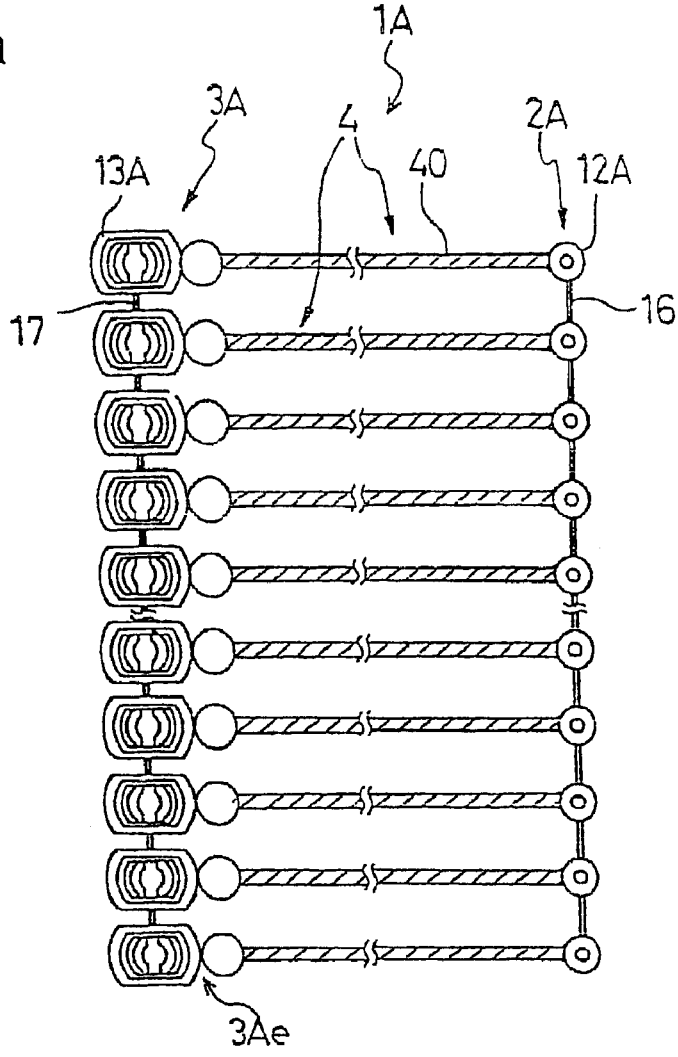
FIG. 11 shows a fixture of indication tag or the like having a magnetic body for marker formed as continuous body coupled by a first temporary linkage member and a second temporary linkage member, (a) is a plane view, and (b) is a side view.
Figure 11B:
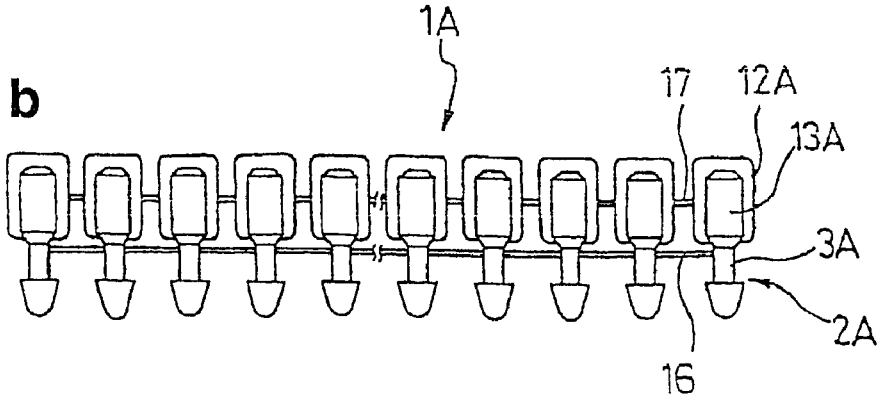

Moreover, in a third continuous body shown in FIG. 11, in the aligned arrangement state of the fixture 1A of indication tag or the like having a number of magnetic bodies for marker, base portions 2Aa of the engagement male portion 2A are linked each other by means of a thin filamentous first temporary linkage portion 16 formed in a small cross-section area, and base portions 3Aa of the engagement female portion 3A are linked each other by means of a thin filamentous second temporary linkage portion 17 formed in a small cross-section area.

Figure 12A:
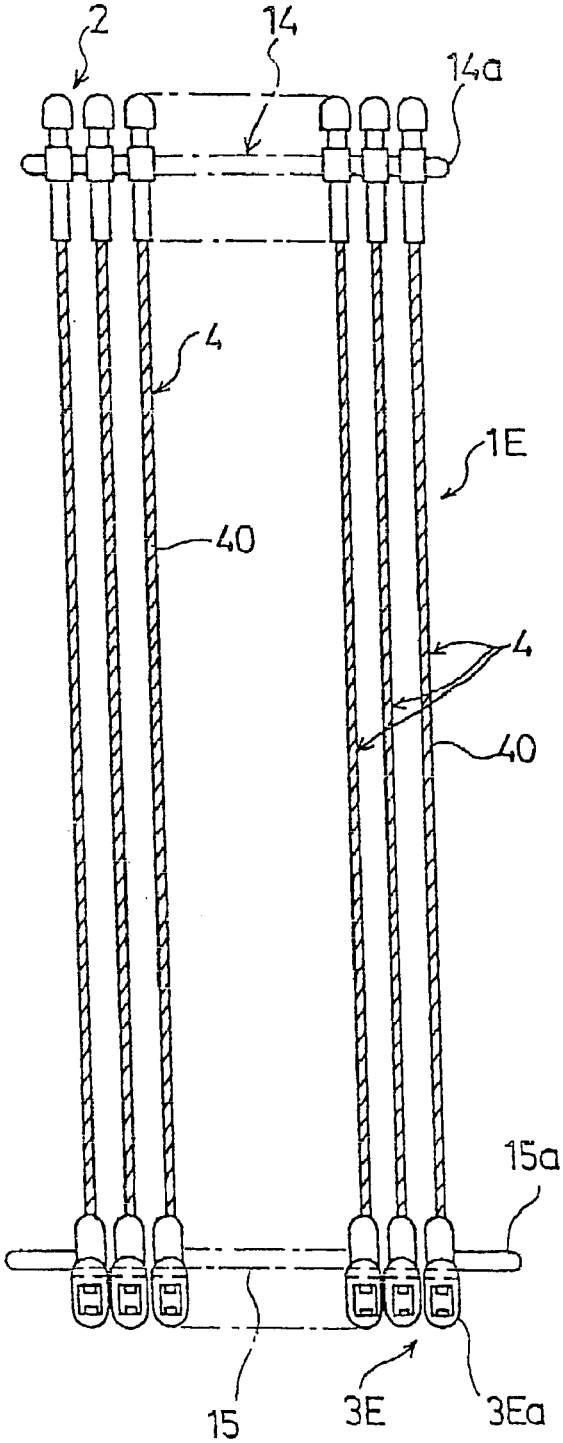
FIG. 12 shows a fixture of indication tag or the like having a magnetic body for marker formed as continuous body coupled by linkage members, (a) is a plane view, and (b) is a front view.
Figure 12B:
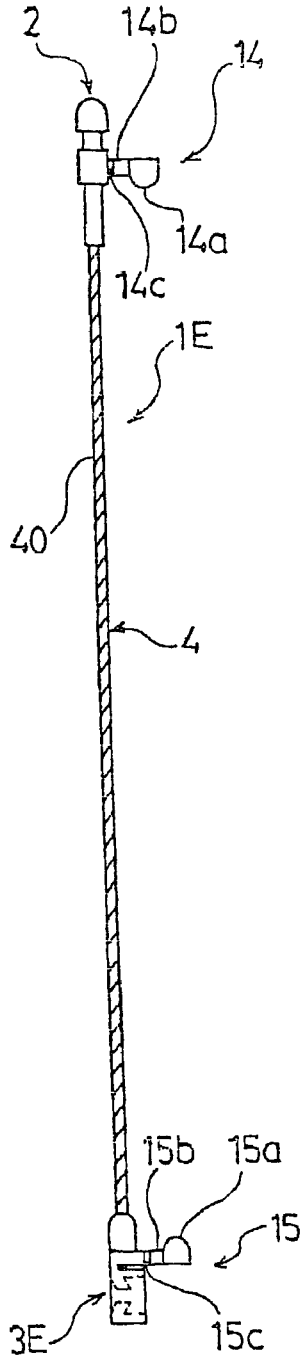
Figure 13A:
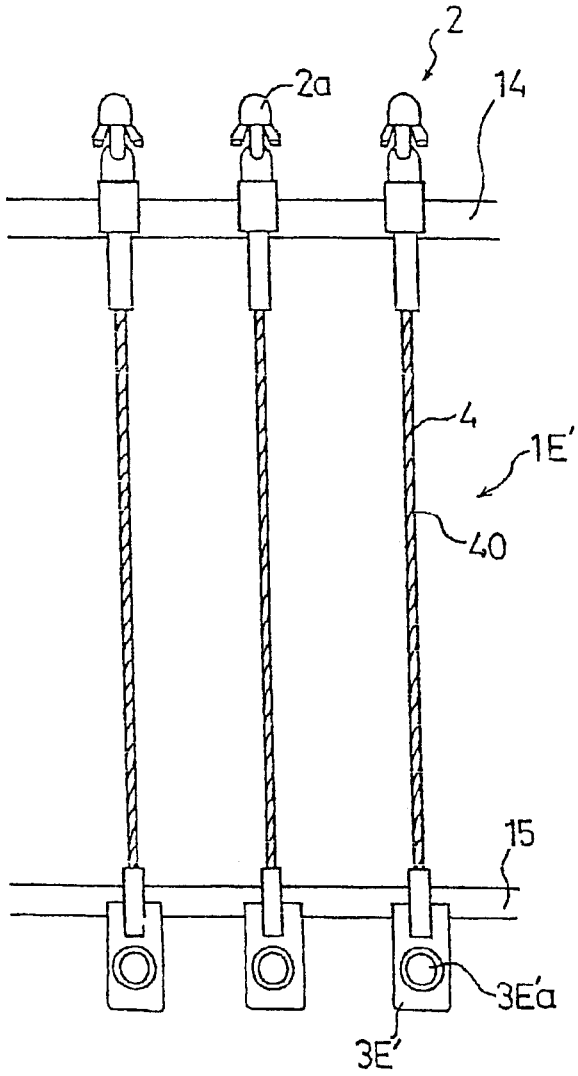
FIG. 13 shows a fixture of indication tag or the like having a magnetic body for marker formed as continuous body coupled by linkage members, (a) is a plane view, and (b) a front view, and (c) a partial section view showing the engagement female portion.
Figure 13B:
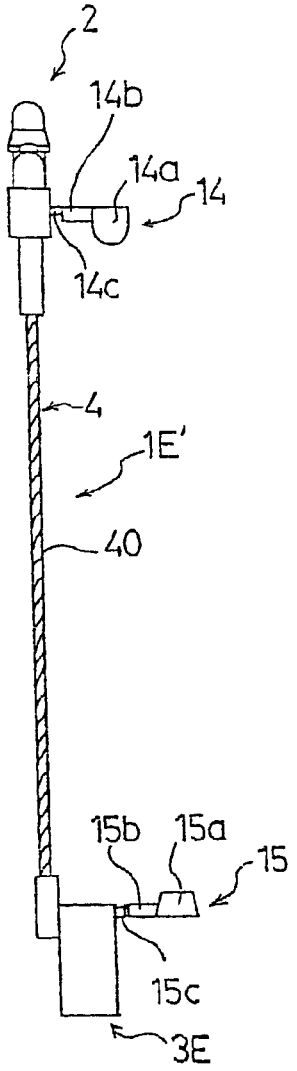
Figure 13B:
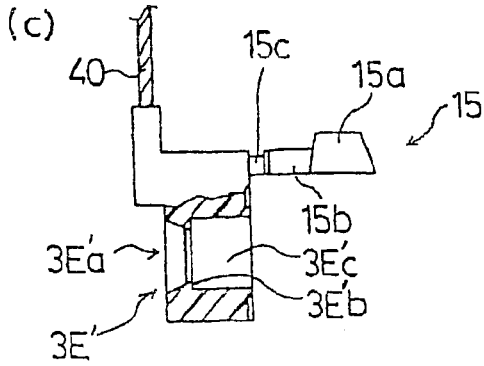

In the continuous body shown in these FIG. 9 and FIG. 10, the first linkage member 14 and the second linkage member 15 are disposed, respectively, in the extension direction of the filamentous coupling portion 4; however, in the continuous body of FIG. 12 and FIG. 13, they are disposed in a direction orthogonal to the extension direction of the filamentous coupling portion 4.

In FIG. 12, the engagement male portion 2 side of a fixture of indication tag or the like having a magnetic body for marker 1E is linked by a first linkage member 14 through a breakable first cutting portion 14*c*, while an engagement female portion 3E side is linked by a second linkage member 15 through a breakable second cutting portion 15*c*.

Also, in FIG. 13, the engagement male portion 2 side of a fixture of indication tag or the like having a magnetic body for marker 1E' is linked by the first linkage member 14 through the breakable first cutting portion 14*c*, while an engagement female portion 3E' side is linked by the second linkage member 15 through the breakable second cutting portion 15*c*.

The continuous body of fixtures 1A, 1E, 1E' as shown in these FIG. 9 to FIG. 13 is effective in case of using a gun type (pistol type) attachment apparatus (driving machine), and the continuous body is loaded on the attachment apparatus and is cut off individually during the driving.

Then, as for the continuous body of the fixtures 1A as shown in FIG. 9 to FIG. 11, the axial line of the engagement direction of the engagement male portion 2A and the axial line of the engagement direction of the engagement female portion 3A are formed respectively orthogonal to the flat plate lattice face. In short, they are formed so that the movement direction for the engagement of the engagement male portion 2A and engagement female portion 3A, namely, axial direction be orthogonal to the flat plate lattice face including the filamentous coupling portion 4.

According to the configuration, for the loading of the gun type on the attachment apparatus, the engagement male portion 2A and engagement female portion 3A can be loaded, leaving the filamentous coupling portion 4 of fixtures of indication tag or the like arranged as sheet form continuous body, arranged outside the attachment apparatus in U-form, and, when they are forwarded toward the tip side, entanglement can be avoided, because they can be forwarded leaving the filamentous coupling portion 4 in U-form.

In addition, in the configuration, as the first cutting portion 14*c* and first temporary linkage portion 16 can be not disposed at the rear end of the engagement male portion 2A; hence, a mechanism for sending out from a hollow needle by pressing the rear end with an ejection rod can be adopted, as mechanism for sending out the engagement male portion 2A in the attachment apparatus.

It should be appreciated that, the fixture 1A shown in FIG. 10 and FIG. 11 is provided with a breaking portion 3Ae formed weaker in strength than the engagement strength between the engagement male portion 2A and engagement female portion 3A by reducing the cross-section area, at the connection portion between the engagement female portion 3A and the filamentous coupling portion 4. Though not illustrated, the breaking portion may be disposed at the connection portion between the engagement male portion 2A and the filamentous coupling portion 4.

The breaking portion 3Ae is the one permitting to release the loop R by cutting off the engagement female portion 3A and the filamentous coupling portion 4 by folding or twisting off, without using scissors or a cutter. The provision of the breaking portion 3Ae allows a client, after purchasing a commodity 6, to remove simply an indication tag 5 or the like attached by the fixture 1A.

Next, a fixture of indication tag or the like having a magnetic body for marker 1F which is a second embodiment of the present invention shall be described.

Figure 14A:
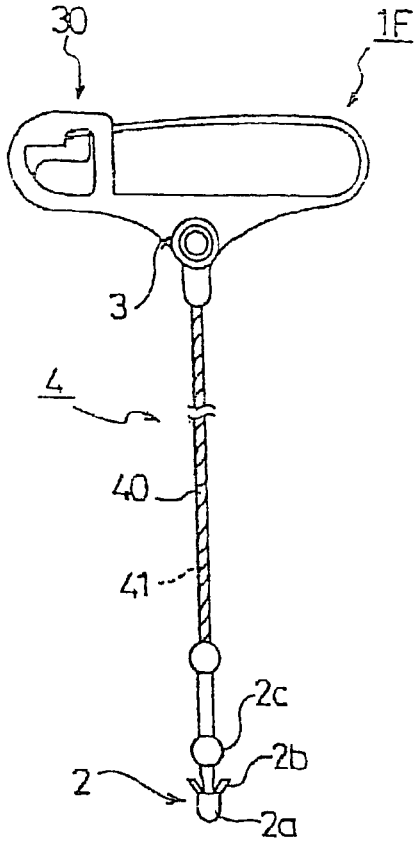
FIG. 14 shows a fixture of indication tag or the like having a magnetic body for marker of a third embodiment according to the present invention, (a) is a front view, and (b) a side view.
Figure 14B:
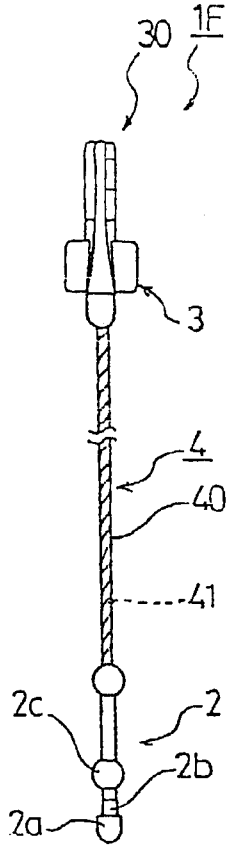
Figure 15:
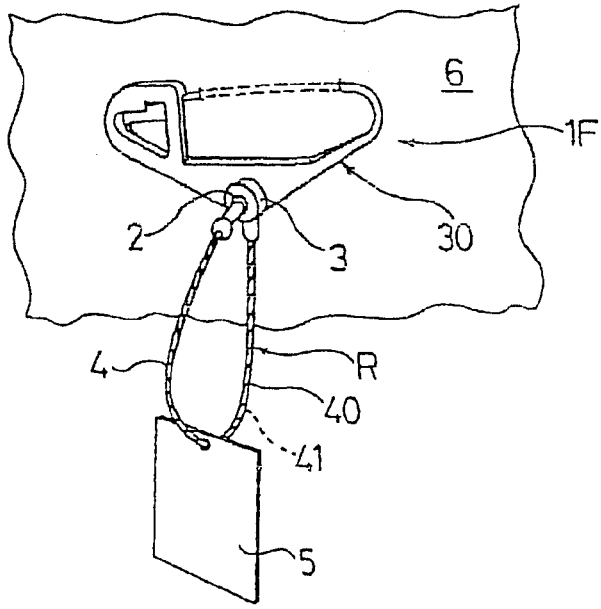
FIG. 15 shows a state where an indication tag is attached by means of the fixture of indication tag or the like having a magnetic body for marker of FIG. 14.

As shown in FIG. 14 and FIG. 15, the fixture 1F is formed by connecting an engagement male portion 2 to one end side of the filamentous coupling portion 4, and an engagement female portion 3 and a fitting portion 30 that can be fitted to a commodity such as garments, to the other end side.

There, the filamentous coupling portion 4 is formed completely identical to the filamentous coupling portion 4 of the fixture 1 which is the first embodiment.

The engagement male portion 2, engagement female portion 3 and fitting portion 30 are not particularly limited; however, in FIG. 14 and FIG. 15, the engagement male portion 2 and engagement female portion 3 are formed similar to the fixture 1 which is the first embodiment of FIG. 1 to FIG. 3, while the fitting portion 30 is formed by a safety pin.

Then, in case of using the fixture of 1F, as shown in FIG. 15, a loop R for holding an indication tag 5 by engaging the engagement male portion 2 and engagement female portion 3 is formed by a filament 40, and fitted to a commodity 6 such as garments, purse, or others by a fitting portion 30.

There, a state where a soft magnetic material fiber 41 constituting the magnetic body for marker is attached to the commodity 6 is achieved.

Next, a fixture of indication tag or the like having a magnetic body for marker 1G of a third embodiment of the present invention shall be described.

Figure 16A:
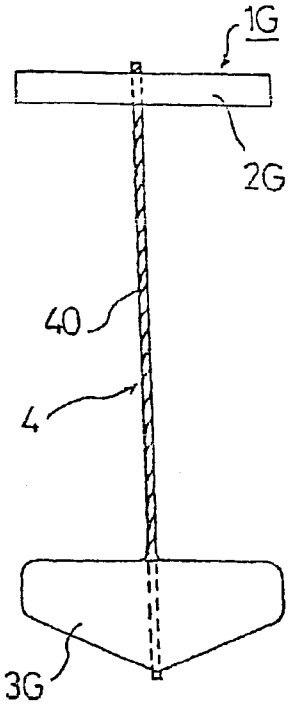
FIG. 16 shows a fixture of indication tag or the like having a magnetic body for marker of a third embodiment according to the present invention, (a) is a front view, and (b) a side view.
Figure 16B:
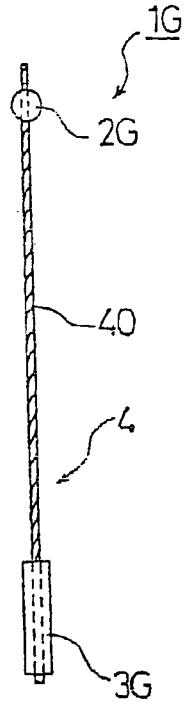
Figure 17:
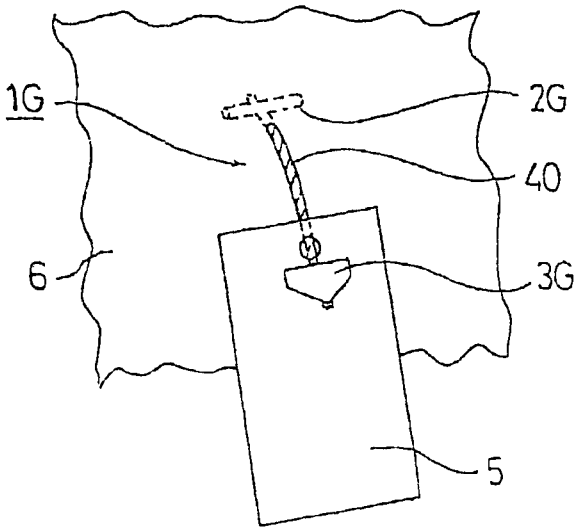
FIG. 17 shows a state where an indication tag is attached by means of the fixture of indication tag or the like having a magnetic body for marker of FIG. 16.

As shown in FIG. 16 and FIG. 17, the fixture 1G is formed by connecting a crossbar portion 2G to one end side of the filamentous coupling portion 4, and a head 3G to the other end side thereof.

When the crossbar portion 2G is joined with the filamentous coupling portion 4 in a shape crossing (with right angles in FIG. 16 and FIG. 17) the filamentous coupling portion 4, and stuck into a small hole or fabric of an article of garments, it becomes approxiately parallel to the filamentous coupling portion 4, stuck with the same, and thereafter, it restores its crossing shape in respect to the filamentous coupling portion 4, preventing from slipping off. Besides, the head 3G is formed into a flat plate shape, and is formed larger than the cross-section area of the filamentous coupling portion 4, in order to deploy the loosening prevention function.

There, the filamentous coupling portion 4 is formed completely identical to the filamentous coupling portion 4 of the fixture 1 which is the first embodiment.

In case of using the fixture 1G, as shown in FIG. 17, after having passed the crossbar portion 2G through a through hole of an indication tag 5, it is attached to a commodity 6 by passing through an attachment hole of an article of garments, or by passing the crossbar portion 2G by opening a hole in the fabric. In this case, the indication tag 5 is held by the filamentous coupling portion 4 having a soft magnetic material fiber 41, the head 3G and the crossbar portion 2G act as slipping-off protector.

In other words, the crossbar portion 2G, filamentous coupling portion 4 and head 3G form substantially a H-shape, the middle filamentous coupling portion 4 is inserted into commodity 6 such as a garment article or an indication tag 5, and the crossbar portion 2G and the head 3G form a slipping-off protector.

There, a state where a soft magnetic material fiber 41 is attached to the commodity 6 is achieved.

Next, a fixture of indication tag or the like having a magnetic body for marker 10 which is a fourth embodiment of the present invention shall be described.

Figure 18A:
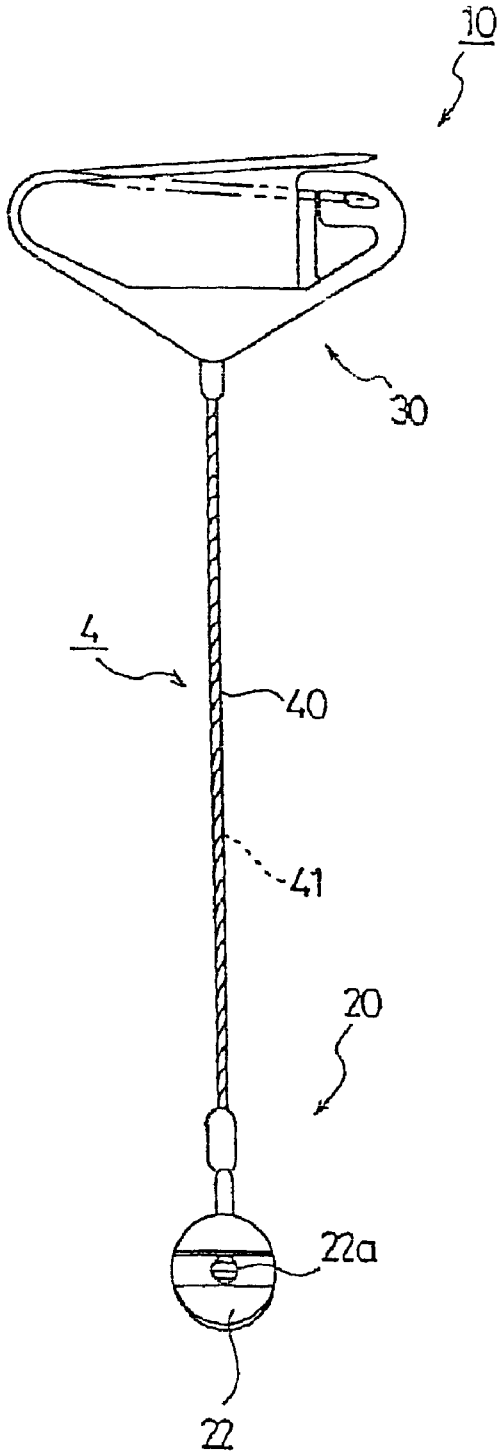
FIG. 18 shows a first example of fixture of indication tag or the like having a magnetic body for marker of a fourth embodiment according to the present invention, (a) is a front view, and (b) a side view.
Figure 18B:
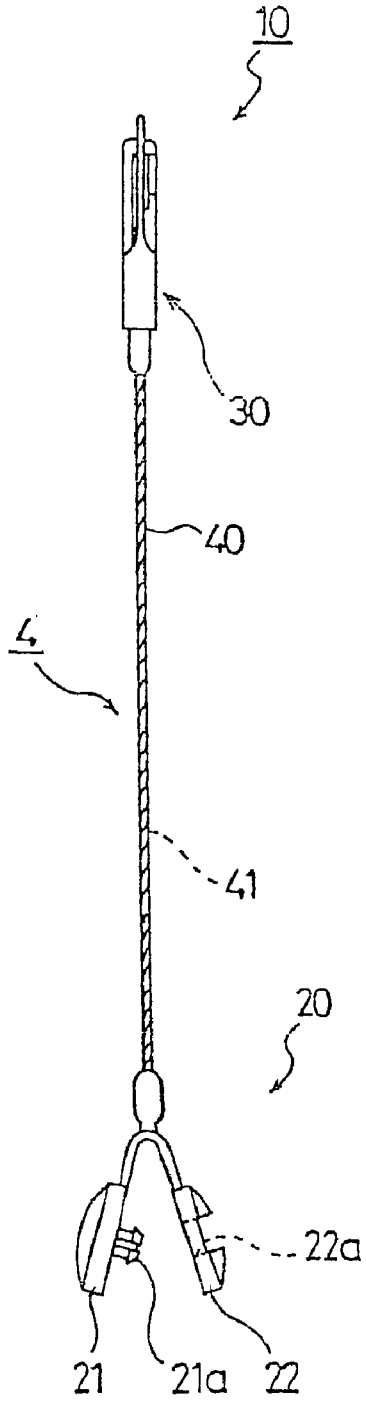

As shown in FIG. 18, the fixture 10 is formed by connecting a holding portion 20 for holding an indication tag or the like and a fitting portion 30 that can fitted to a commodity such as garments or others are connected respectively to both ends of the filamentous coupling portion 4.

There, the filamentous coupling portion 4 is formed completely identical to the filamentous coupling portion 4 of the fixture 1 which is the first embodiment.

The holding portion 20 has an engagement male portion 21 and an engagement female portion 22 made of synthetic resin, and is configured to allow to pinch the through hole portion of the indication tag 5, as shown in FIG. 18 to FIG. 21, by engaging the engagement male portion 21 having an expandable and shrinkable head 21*a* and the engagement female portion 22 having a through hole 22*a*.

Figure 19:
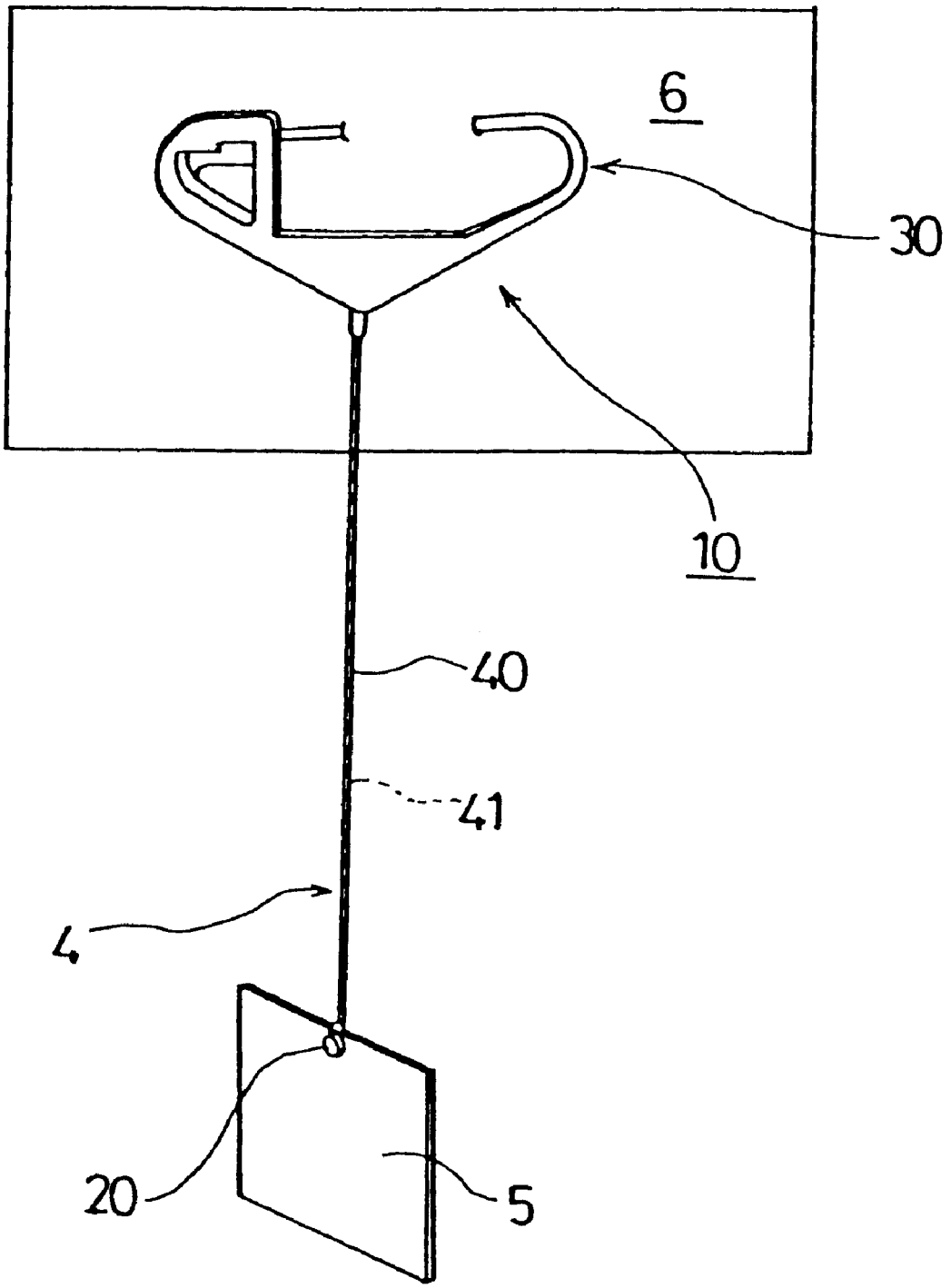
FIG. 19 shows a state where an indication tag is attached by means of the fixture of indication tag or the like having a magnetic body for marker of FIG. 18.
Figure 20A:
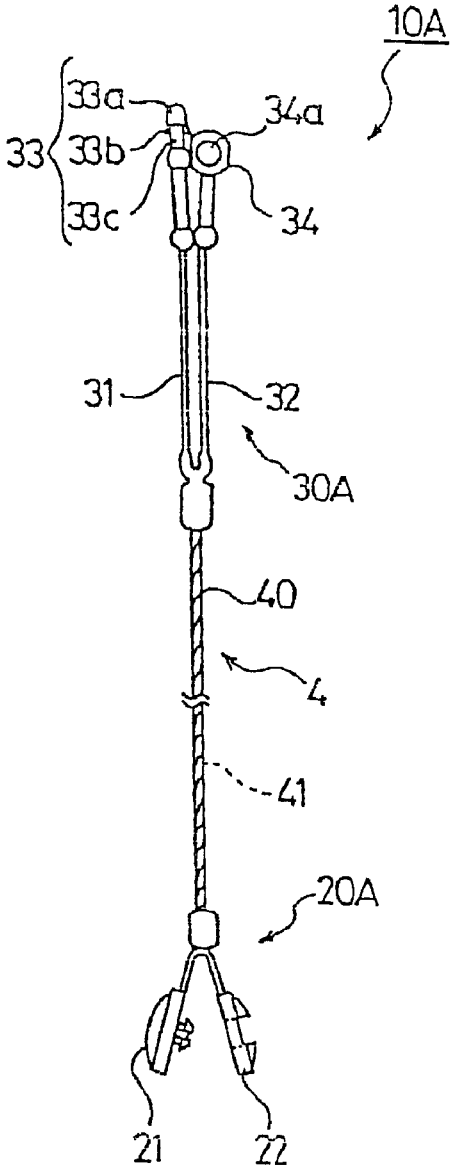
FIG. 20 shows a second example of fixture of indication tag or the like having a magnetic body for marker of the fourth embodiment according to the present invention, (a) is a front view, and (b) a side view.
Figure 20B:
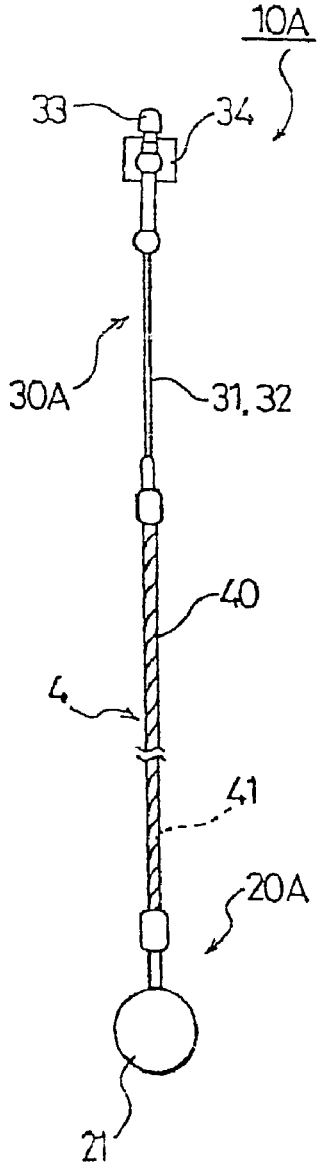
Figure 21:
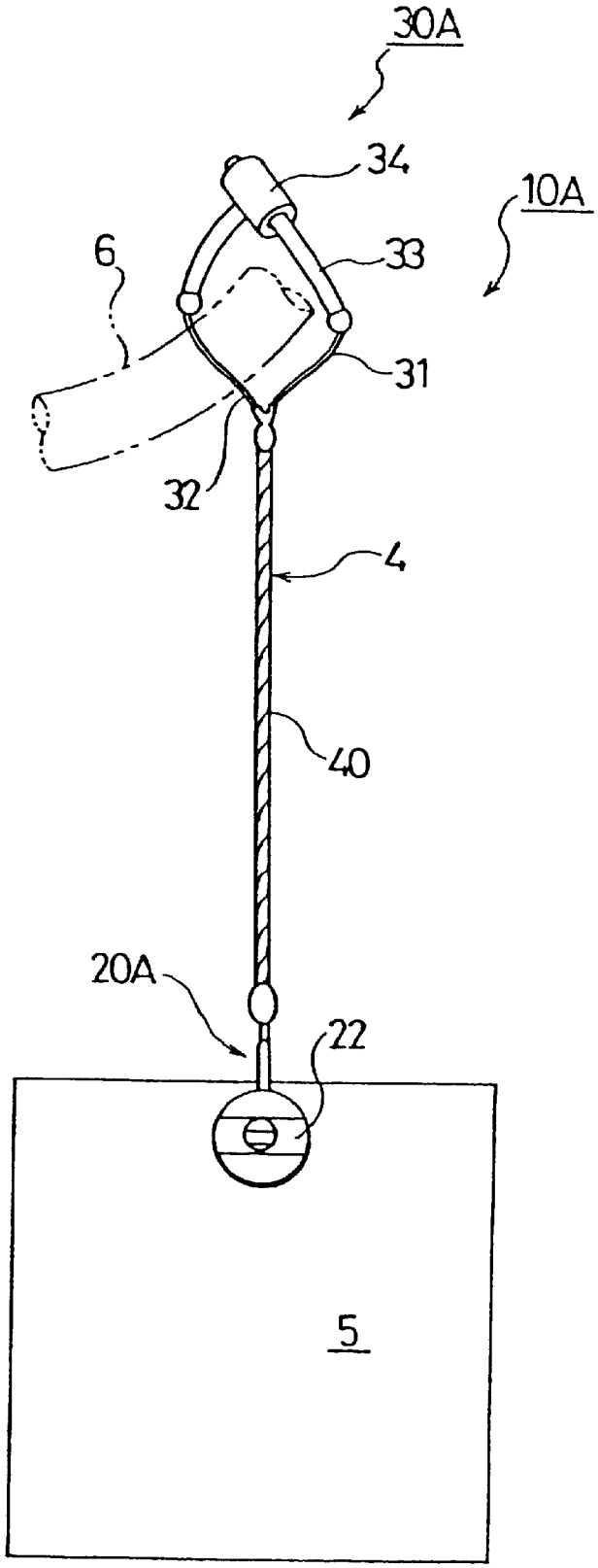
FIG. 21 shows a state where an indication tag is attached by means of the fixture of indication tag or the like having a magnetic body for marker of FIG. 20.

On the other hand, the fitting portion 30 can be formed with a safety pin 30 as shown in FIG. 18 and FIG. 19, or a small loop forming body 30A as shown in FIG. 20 and FIG. 21. The small loop forming body 30A has the engagement male portion 33 and engagement female portion 34 at the tip of a forked filament portion 31, 32, and a small loop is formed with the filament portion 31, 32 by engaging these engagement male portion 33 and engagement female portion 34 and attached to a commodity 6 such as purse or others.

The other well-known configurations can also be used for the fitting portion 30, provided that the configuration allows to attach to a commodity such as garments or others.

In case of using the fixture of indication tag or the like having a magnetic body for marker 10, 10A, the indication tag 5 is held by engaging the engagement male portion 21 and engagement female portion 22 of the holding portion 20, and fitted to a commodity 6 such as garments, purse or others, by the fitting portion 30, 30A.

There, in this state, as the soft magnetic material fiber 41 which is a magnetic body for marker is attached to the commodity 6, if the soft magnetic material fiber 41 enters the sensing gate without passing through a regular route, the presence thereof is detected, allowing to know the presence of the commodity.

It should be appreciated that, in case of passing through a regular route, the semi-rigid magnetic material 43 is magnetized by passing through a magnetic field for deactivating the soft magnetic material fiber 41, making the sensing by the sensing gate impossible.

According to the fixture 1, 10, the soft magnetic material fiber 41 constituting the magnetic body for marker is arranged as core material 40*a* in the filamentous coupling portion 4 forming a loop, or filamentous coupling portion 4 for hanging an indication tag held by the holding portion 20, and the core material 40*a* is coated with cover material 44, preventing the consumer from noticing the presence of the magnetic body for marker in the filamentous coupling portion 4, at a first glance, and allowing to use as an effective marker.

In addition, the filament 40 forming the filamentous coupling portion 4 does not provoke a feeling of wrongness when an indication tag is attached to a commodity or furniture, conceals the presence of the soft magnetic material fiber 41 constituting the magnetic body for marker, and consequently, cutting off or destruction thereof by the consumer or others disappear.

Besides, as a soft magnetic material fiber 41 presenting an excellent magnetic properties is arranged in the core material 40*a* of the filamentous coupling portion 4, it becomes easy to secure a length for generating a magnetic force change necessary for sensing by the sensing system, and a detection signal can be generated by a detection coil in the gate, through an easy magnetization in the alternating filed generated in a magnetic type antitheft gate.

Hence, the use of the fixture 1, 10 permits to fulfill a security function for antitheft, in addition to the ordinary function of attachment of indication tag or the like.

INDUSTRIAL APPLICABILITY

The present invention has an object to provide a fixture of indication tag or the like having a magnetic body for marker that can conceal the location of the magnetic body for marker, thereby obscure the location of the magnetic body for marker and prevent it from being removed, by arranging secretly the magnetic body for marker, in a filamentous coupling portion for coupling an engagement male portion and an engagement female portion or in a filamentous coupling portion for coupling a holding portion and a fitting portion.

Hence, the present invention can be applied to a remote sensitive antitheft system for preventing commodities in a store or furnishings or others from being taken away without leave, by providing commodities in a store or furniture of public facilities or others with a magnetic body for marker using the magnetic reaction property of a soft magnetic body to the alternating field, and at the same time, and arranging a sensing gate for generating the alternating field at the exit.

What is claimed is:

1. A fixture of indication tag having a magnetic body for marker formed by connecting an engagement male portion to one end side of a filamentous coupling portion (4) and an engagement female portion to the other end side, and forming a loop by engaging said engagement male portion and said engagement female portion, wherein said filamentous coupling portion (4) is formed with a filament (40) having a soft magnetic material fiber (41), wherein the filament (40) having said soft magnetic material fiber (41) is formed by forming a core material (40*a*) thereof from a soft magnetic material fiber (41), or a soft magnetic material fiber (41) and a core yarn (42), and coating the core material (40*a*) with a cover material (44).

2. The fixture of indication tag having a magnetic body for marker of claim 1, wherein said engagement male portion is linked by a first linkage member (14) through a first cutting portion (14*c*) where the portion is reduced and, at the same time, said engagement female portion is linked by a second linkage member (15) through a second cutting portion (15*c*) where the portion is reduced, and formed into a flat plate lattice shape continuous body.

3. The fixture of indication tag having a magnetic body for marker of claim 1, wherein said engagement male portion includes a plurality of engagement male portions, the plurality of engagement male portions are linked each other by a first temporary linkage member (16) formed with a filamentous small cross-section area and, at the same time, wherein said engagement female portion includes a plurality of engagement female portions, the plurality of engagement female portions are linked by a second linkage member (15) through a second cutting portion (15*c*) where the portion is reduced, and formed into a flat plate lattice shape continuous body.

4. The fixture of indication tag having a magnetic body for marker of claim 1, wherein said engagement male portion includes a plurality of engagement male portions, the plurality of engagement male portions are linked each other by a first temporary linkage member (16) formed with a filamentous small cross-section area and, at the same time, wherein said engagement female portion includes a plurality of engagement female portions, the plurality of engagement female portions are linked each other by a second temporary linkage member (17) formed with a filamentous small cross-section area, and formed into a flat plate lattice shape continuous body.

5. The fixture of indication tag having a magnetic body for marker of claim 2, wherein said first linkage member (14) and said second linkage member (15) are installed in the elongation direction of said filamentous coupling portion (4).

6. The fixture of indication tag having a magnetic body for marker of claim 2, wherein said first linkage member (14) and said second linkage member (15) are installed in a direction crossing with the elongation direction of said filamentous coupling portion (4).

7. The fixture of indication tag having a magnetic body for marker of any one of claims 2 to 6, wherein the axial line in the engagement direction of said engagement male portion and the axial line in the engagement direction of said engagement female portion are formed respectively to cross a flat plate lattice plane.

8. The fixture of indication tag having a magnetic body for marker of any one of claims 1 to 6, wherein a breaking portion having a breaking portion strength and engagement between said engagement male portion and said engagement female portion has an engagement strength, the breaking portion strength being weaker than the engagement strength between said engagement male portion and said engagement female portion, the breaking portion being installed at the joint portion between said engagement male portion and said filamentous coupling portion, or the joint portion between said engagement female portion and said filamentous coupling portion.

9. In a fixture for suspending an indication tag (1G), comprising a filamentous coupling portion (4), a crossbar portion (2G) joined to one end side of the filamentous coupling portion (4) crossing with the filamentous coupling portion (4), and a head (3G) joined to the other end side of the filamentous coupling portion (4) and at the same time formed larger than the cross-section area of the filamentous coupling portion (4), and having a loosening prevention function; a fixture of indication tag having a magnetic body for marker, wherein said filamentous coupling portion (4) is formed with a filament (40) having soft magnetic material fiber (41), wherein the filament (40) having said soft magnetic material fiber (41) is formed by forming a core material (40*a*) thereof from a soft magnetic material fiber (41), or a soft magnetic material fiber (41) and a core yarn (42), and coating the core material (40*a*) with a cover material (44).

10. A fixture of indication tag having a magnetic body for marker, comprising a holding portion having an engagement male portion and an engagement female portion made of synthetic resin and holding an indication tag by engaging said engagement male portion and said engagement female portion, a fitting portion capable of being fitted to a commodity such as garments, and a filamentous coupling portion (4) for coupling said holding portion and said fitting portion, wherein said filamentous coupling portion (4) is formed with a filament (40) having a soft magnetic material fiber (41), wherein the filament (40) having said soft magnetic material fiber (41) is formed by forming a core material (40*a*) thereof from a soft magnetic material fiber (41), or a soft magnetic material fiber (41) and a core yarn (42), and coating the core material (40*a*) with a cover material (44).

11. The fixture of indication tag having a magnetic body for marker of any one of claims 1 to 6, 9 or 10, wherein the filament (40) having said soft magnetic material fiber (41) is formed by forming a core material (40*a*) thereof from a soft magnetic material fiber (41), or a soft magnetic material fiber (41) and a core yarn (42), and coating the core material (40*a*) with a cover material (44) together with a semi-rigid magnetic material (43).

12. The fixture of indication tag having a magnetic body for marker of any one of claims 1 to 6, 9 or 10, wherein the filament (40) having said soft magnetic material fiber (41) is formed by forming a core material (40*a*) thereof from a soft magnetic material fiber (41), or a soft magnetic material fiber (41) and a core yarn (42), and coating the core material (40*a*) with a cover material (44) together with a heat welding yarn (45).

13. The fixture of indication tag having a magnetic body for marker of any one of claims 1 to 6, 9 and 10, wherein the cover material (44) is wound in a spiral shape around the core material (44*a*).

* * * * *